US011828143B2

(12) United States Patent
Koon

(10) Patent No.: US 11,828,143 B2
(45) Date of Patent: Nov. 28, 2023

(54) DEVICES FOR A PERFORATING GUN

(71) Applicant: Steel Dog Industries Inc., Charleroi, PA (US)

(72) Inventor: Jason R. Koon, Charleroi, PA (US)

(73) Assignee: STEEL DOG INDUSTRIES INC., Charleroi, PA (US)

( * ) Notice: Subject to any disclaimer, the term of this patent is extended or adjusted under 35 U.S.C. 154(b) by 313 days.

(21) Appl. No.: 17/029,250

(22) Filed: Sep. 23, 2020

(65) Prior Publication Data

US 2022/0251930 A1 Aug. 11, 2022

Related U.S. Application Data

(60) Provisional application No. 62/932,114, filed on Nov. 7, 2019, provisional application No. 62/907,191, filed on Sep. 27, 2019.

(51) Int. Cl.

| | |
|---|---|
| ***E21B 43/119*** | (2006.01) |
| ***F42D 1/055*** | (2006.01) |
| *E21B 43/116* | (2006.01) |

(52) U.S. Cl.

CPC ..... *E21B 43/119* (2013.01); *F42D 1/055* (2013.01); *E21B 43/116* (2013.01)

(58) Field of Classification Search

CPC ... F42D 1/00; F42D 1/04; F42D 1/041; F42D 1/042; F42D 1/043; F42D 1/045; F42D 1/05; F42D 1/22; F42B 3/02; F42B 3/103; F42B 3/26; E21B 17/028; E21B 43/11; E21B 43/116; E21B 43/1185; E21B 43/119

USPC ..... 89/1.15

See application file for complete search history.

(56) References Cited

U.S. PATENT DOCUMENTS

| | | | | |
|---|---|---|---|---|
| 3,327,792 | A * | 6/1967 | Boop | E21B 43/1185 175/4.54 |
| 8,256,337 | B2 * | 9/2012 | Hill | F42B 3/26 89/1.15 |
| 8,661,978 | B2 * | 3/2014 | Backhus | F42B 3/122 102/202.3 |
| 8,770,301 | B2 * | 7/2014 | Bell | E21B 43/119 166/55 |
| 9,494,021 | B2 * | 11/2016 | Parks | E21B 43/1185 |
| 9,689,223 | B2 * | 6/2017 | Schacherer | E21B 43/1185 |
| 9,822,618 | B2 * | 11/2017 | Eitschberger | F42D 1/045 |
| 10,689,955 | B1 * | 6/2020 | Mauldin | F16C 35/06 |
| 11,021,923 | B2 * | 6/2021 | Mulhern | E21B 23/0414 |
| 11,091,987 | B1 * | 8/2021 | Benker | E21B 43/1185 |
| 2016/0356132 | A1 * | 12/2016 | Burmeister | E21B 43/1185 |
| 2019/0153827 | A1 * | 5/2019 | Goyeneche | E21B 17/02 |

(Continued)

FOREIGN PATENT DOCUMENTS

| | | | | |
|---|---|---|---|---|
| WO | WO-2017054046 | A1 * | 4/2017 | E21B 17/02 |

*Primary Examiner* — Joshua E Freeman
*Assistant Examiner* — Benjamin S Gomberg
(74) *Attorney, Agent, or Firm* — Lippes Mathias LLP

(57) ABSTRACT

Three different devices for increasing compatibility between older perforating gun systems and newer perforating gun systems are disclosed. One end cap adapted for use with a charge carrier includes a cutout for holding an addressable switch. Another end cap adapted for use with a charge carrier provides a route for transmission of electrical signals. A pin-to-pin tandem sub also provides a route for transmission of electrical signals between perforating guns.

20 Claims, 17 Drawing Sheets

(56) References Cited

U.S. PATENT DOCUMENTS

| | | | | |
|---|---|---|---|---|
| 2019/0212118 | A1* | 7/2019 | Saltarelli | F42C 15/34 |
| 2019/0234188 | A1* | 8/2019 | Goyeneche | E21B 43/119 |
| 2020/0256166 | A1* | 8/2020 | Knight | E21B 43/1185 |
| 2020/0362676 | A1* | 11/2020 | Goyeneche | E21B 43/11855 |
| 2022/0235634 | A1* | 7/2022 | Lagrange | F42D 1/05 |

* cited by examiner

DEVICES FOR A PERFORATING GUN

CROSS-REFERENCE TO RELATED APPLICATIONS

This application claims priority to U.S. Provisional Patent Application Ser. No. 62/932,114, filed on Nov. 7, 2019, and to U.S. Provisional Patent Application Ser. No. 62/907,191, filed on Sep. 27, 2019, which are incorporated by reference in their entirety.

BACKGROUND

The present disclosure relates to devices useful in assembling a perforating gun. Such devices include end caps of different structures and a sub that can be used with the end caps. These devices promote interchangeability of older charge carriers with newer pin-to-pin models.

Oil and gas exploration and production, as well as other subterranean activities (e.g., water exploration and extraction), involve drilling and completing a wellbore. The wellbore is drilled into the ground and then can be lined with metal pipe generally referred to as casing. The casing may also be cemented in place, sealing the annulus between the casing and the earthen formation.

To create flow paths between the wellbore and the formation, a perforating gun is used. These flow paths are often created by utilizing a perforating gun. Perforating guns are tubular-shaped devices having an outer housing that holds one or more interconnected charge carriers. The charge carrier holds multiple shaped explosive charges ("shots") positioned about the circumference thereof and aimed in a radial direction. A perforating gun may incorporate multiple charge carriers, which are separated by a tandem sub.

To detonate the shaped charges, the perforating gun includes an addressable switch for each charge carrier. The addressable switch receives an electrical signal that is transmitted from the surface and/or from another location, and then initiates a detonator to ignite a detonating cord. The detonating cord extends through the charge carrier and is interconnected with the shaped charges held by the charge carrier. When detonated, the shaped charges create perforations through the wellbore casing/cement and into the earthen formation. Typically, the addressable switch is placed within the tandem sub, such that there is one tandem sub for each charge carrier. The tandem sub is reusable.

Changes in technology have led to new perforating gun systems that operate differently from older perforating gun systems. However, there is a substantial financial investment in the older reusable systems. It would be desirable to provide devices that permit the older systems to be compatible and usable with the newer systems.

BRIEF DESCRIPTION

Disclosed in the present disclosure are various devices that can be used to increase compatibility between older perforating gun systems and newer perforating gun systems. These devices include different end caps to be used with the charge carriers, and also newer subs for transmission of electrical signals using a pin-to-pin system.

Disclosed in various embodiments is a bottom end cap for a perforating gun, comprising: (A) a main body defining a first end of the end cap; (B) a tube defining a second end of the end cap; (C) a collar between the body and the tube, the collar forming a stop surface facing the second end of the end cap; (D) a shaft passing through the tube and the collar;

(E) a first hole extending entirely through the collar and the main body; and (F) a second hole adjacent the first hole, extending through the collar into the main body and including a stop surface.

In some particular embodiments, the bottom end cap further comprises: (i) an addressable switch located within the main body; (ii) an electrically conductive ground ring on an outer surface of the bottom end cap which is electrically connected to the addressable switch and acts as a ground; and (iii) an electrically conductive core at the second end of the bottom end cap which is electrically connected to the addressable switch and acts as a bottom through-wire. These embodiments of a bottom end cap can further comprise a positive contact wire, a negative contact wire, and a top through-wire which are also electrically connected to the addressable switch. These three wires typically extend out the first end (i.e. out of the main body) of the bottom end cap.

The main body may include a first inner sidewall surrounding the first hole and the second hole, a second inner sidewall surrounding the shaft, and an outer sidewall around a perimeter of the main body. The remainder of the main body may be hollowed out, with the addressable switch being located within a hollowed-out part of the main body.

In other embodiments, the main body includes a sidewall surrounding the first hole and the second hole, and the main body is offset from the shaft. Here, the main body essentially defines the first hole and the second hole. The collar may have at least one opening that is offset from the main body. In some embodiments, the collar can be considered to have one opening through which a support passes, or alternatively to have two openings separated by a support.

In some particular embodiments, the main body includes a cutout beyond a radius of the shaft, and the collar has an opening that is aligned with the cutout of the main body.

Generally, the main body, the tube, and the collar are all cylindrical and are concentric about the shaft. The shaft can extend entirely from the first end to the second end of the end cap. The tube may have a diameter less than a diameter of the main body, and the collar may have a diameter greater than the diameter of the main body.

In some embodiments, the shaft of the bottom end cap may contain: (i) a pin that extends outward from the first end of the bottom end cap, and (ii) an electrically conductive core at the second end of the bottom end cap that is electrically connected to the pin. A spring traveling through the shaft can electrically connect the core to the pin.

In other embodiments, the shaft may contain: (i) an electrically conductive core at the second end of the bottom end cap which is connected to a wire, and (ii) a spring. The core may comprise a head and a tail, with the tail being crimped around the wire, and the wire travelling through a center of the spring. The spring can travel through the shaft.

Also disclosed herein in various embodiments is a top end cap for a perforating gun, comprising: (A) a collar defining a first end of the end cap, the collar forming a stop surface; (B) a main body defining a second end of the end cap; and (C) a shaft passing through the center of the end cap and extending entirely from the first end to the second end of the end cap.

In some embodiments, the shaft of the top end cap may contain: (i) a pin that extends outward from the first end of the top end cap, and (ii) an electrically conductive core at the second end of the top end cap that is electrically connected to the pin. A spring traveling through the shaft can electrically connect the core to the pin.

In other embodiments, the shaft may contain: (i) an electrically conductive core at the second end of the top end cap which is connected to a wire, and (ii) a spring. The core may comprise a head and a tail, with the tail being crimped around the wire, and the wire travelling through a center of the spring. The spring can travel through the shaft.

Also disclosed herein in various embodiments is a sub, comprising: (A) a body having a first end and a second end, with a shaft extending entirely through the body from the first end to the second end; and (B) an electrically conductive rod fixed in place within the shaft, the ends of the rod exposed at the first end and the second end of the body.

In some embodiments, the electrically conductive rod may include two shoulders and may be fixed in place by nuts at each end. The shaft extending through the body of the sub generally has a constant diameter.

In other embodiments, the electrically conductive rod has only one shoulder. The shaft is narrower at the second end of the body, such that the electrically conductive rod can be fixed in place using only one nut at the first end of the body.

The electrically conductive rod can be formed from a wire. The wire can be bent where a shoulder is desired to be located, in two or three dimensions. A non-electrically conductive (i.e. electrically insulating) jacket may surround the electrically conductive rod. When the electrically formed rod is formed from a spring, the material of the non-electrically conductive can also fill in the volume between the coils of the spring.

The sub may have an external thread at the first end and the second end of the body. The sub may have a knurled external surface on a central portion of the main body.

Also disclosed herein are various embodiments of an electrically conductive core assembly, comprising: a core comprising a head and a hollow tail; and an electrical wire inserted into the hollow tail, the electrical wire and the hollow tail forming an electrical connection.

The diameter of the head may be greater than the diameter of the hollow tail. The length of the hollow tail may be greater than the length of the head. The hollow tail can be crimped around the electrical wire. In some embodiments, the electrical wire has a length of about one foot to about three feet.

The assembly may further comprise a spring. Generally, the electrical wire runs through the center of the spring. The head may have a diameter greater than a diameter of the spring, permitting the head to act as a stop surface for the spring. The spring may have a length greater than a length of the tail. The electrical wire may extend beyond the spring.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

FIG. 1A is a perspective view of a conventional charge carrier and a barrel, separated from each other.

FIG. 1B is a magnified view of a first end plate of the charge carrier.

FIG. 1C is a magnified view of a second end plate of the charge carrier.

FIG. 2A is a front view of the bottom end cap.

FIG. 2B is a lower perspective view of the bottom end cap.

FIG. 2C is an upper perspective view of the bottom end cap.

FIG. 2D is a plan view of the bottom end cap.

FIG. 2E is a side view of the bottom end cap.

FIG. 3A is a first perspective view of the bottom end cap.

FIG. 3B is a second perspective view of the bottom end cap, rotated around a central axis relative to FIG. 3A.

FIG. 3C is a side view of the bottom end cap.

FIG. 3D is a top view of the bottom end cap.

FIG. 3E is a bottom view of the bottom end cap.

FIG. 4A is an upper perspective view of the bottom end cap.

FIG. 4B is a lower perspective view of the bottom end cap, having a lower ground ring around the main body.

FIG. 4C is a lower perspective view of the bottom end cap, without the lower ground ring around the main body.

FIG. 4D is a side cross-sectional view of the bottom end cap.

FIG. 4E is an exploded view of the bottom end cap.

FIG. 5A is a front view of the top end cap.

FIG. 5B is a lower perspective view of the top end cap.

FIG. 5C is an upper perspective view of the top end cap.

FIG. 5D is a cross-sectional view of the top end cap.

FIG. 6A is an exterior perspective view of the pin-to-pin tandem sub.

FIG. 6B is a side view of a through-pin used in the pin-to-pin tandem sub. The through-pin is formed from an electrically conductive rod and a non-electrically conductive jacket.

FIG. 6C is a side view of the electrically conductive rod.

FIG. 6D is a side view of the non-electrically conductive jacket.

FIG. 8B is a perspective view.

FIG. 8C is a side view.

FIG. 8D is a side cross-sectional view.

FIG. 8E is a perspective view.

FIG. 8F is a side view.

FIG. 8G is a side cross-sectional view.

FIG. 11A is a side view of the core.

FIG. 11B is an upper perspective view of the core.

FIG. 11C is a lower perspective view of the core.

DETAILED DESCRIPTION

Figure 1A:
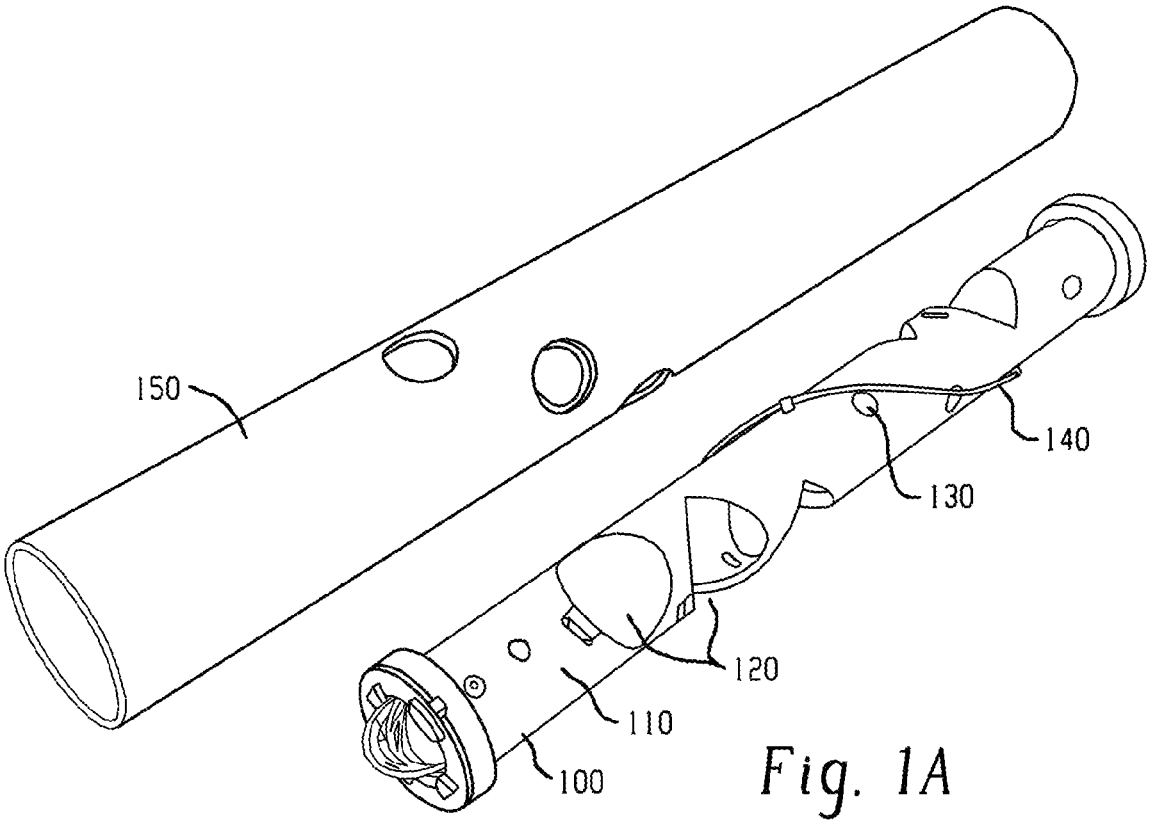
Fig. 1A PRIOR ART
FIGS. 1A-1C are various views of a conventional charge carrier and barrel used to form a perforating gun.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the terms "comprise(s)," "include(s)," "having," "has," "can," "contain(s)," and variants thereof, as used herein, are intended to be open-ended transitional phrases, terms, or words that require the presence of the named components/ingredients/steps and permit the presence of other components/ingredients/steps. However, such description should be construed as also describing systems or devices or compositions or processes as "consisting of" and "consisting essentially of" the enumerated components/ingredients/steps, which allows the presence of only the named components/ingredients/steps, along with any unavoidable impurities that might result therefrom, and excludes other components/ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The modifier "about" should also be considered as disclosing the range defined by the absolute values of the two endpoints. For example, the expression "from about 2 to about 4" also discloses the range "from 2 to 4." The term "about" may refer to plus or minus 10% of the indicated number.

It should be noted that many of the terms used herein are relative terms. For example, the terms "upper" and "lower" are relative to each other in location, i.e. an upper component is located at a higher elevation than a lower component in a given orientation. The terms "top" and "bottom" or "base" are also relative to each other, as are the terms "upward" and "downward". Some of the components described herein can be inverted, so that such relative terms are appropriate.

The terms "horizontal" and "vertical" are used to indicate direction relative to an absolute reference, i.e. ground level. However, these terms should not be construed to require structures to be absolutely parallel or absolutely perpendicular to each other.

The present disclosure relates to perforating guns and various components used therewith. Conventional components are described first, and the inventive devices are then described.

Figure 1B:
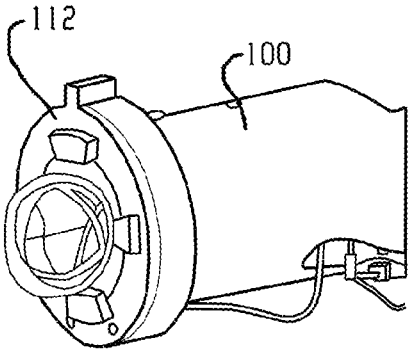
Fig. 1B PRIOR ART
Figure 1C:
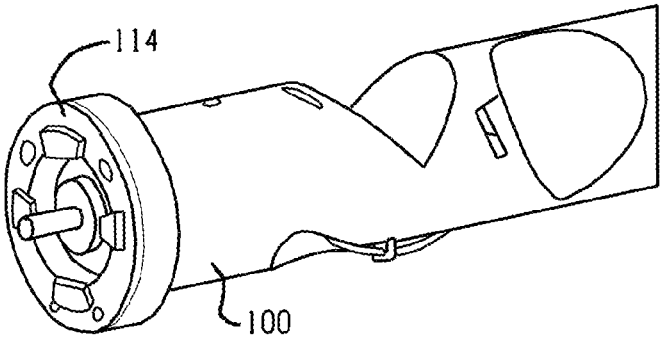
Fig. 1C PRIOR ART

FIGS. 1A-1C are various views of a conventional charge carrier 100. FIG. 1A is a perspective view of a charge carrier 100 and a barrel 150, separated from each other. FIG. 1B is a magnified view of a first end plate 112 of the charge carrier. FIG. 1C is a magnified view of a second end plate 114 of the charge carrier.

Referring first to FIG. 1A, the charge carrier 100 is in the form of a long cylindrical tube defined by a sidewall 110. The sidewall includes a number of cutouts 120 for shots, which are set so that the shot explodes radially, i.e. perpendicular to the sidewall. Six cutouts are visible in the various views, although the number can vary. A smaller sized opening 130 is directly opposite each of the cutouts. The shots in each charge carrier are joined together by a detonator cord (not shown) which wraps around the exterior of the charge carrier and is attached to the back of each shot. A through wire 140 also wraps around the exterior of the charge carrier, usually next to the detonator cord.

In operation, the charge carrier 100 is placed within the barrel 150. The two ends of the barrel include internal threads (not visible) which are used to engage a tandem sub. The charge carrier and barrel together form a perforating gun.

FIG. 1B is a view of a first or bottom end plate 112 of the charge carrier. FIG. 1C is a view of a second or top end plate 114 of the charge carrier. These end plates are located at opposite axial ends of the sidewall of the charge carrier.

Figure 1D:
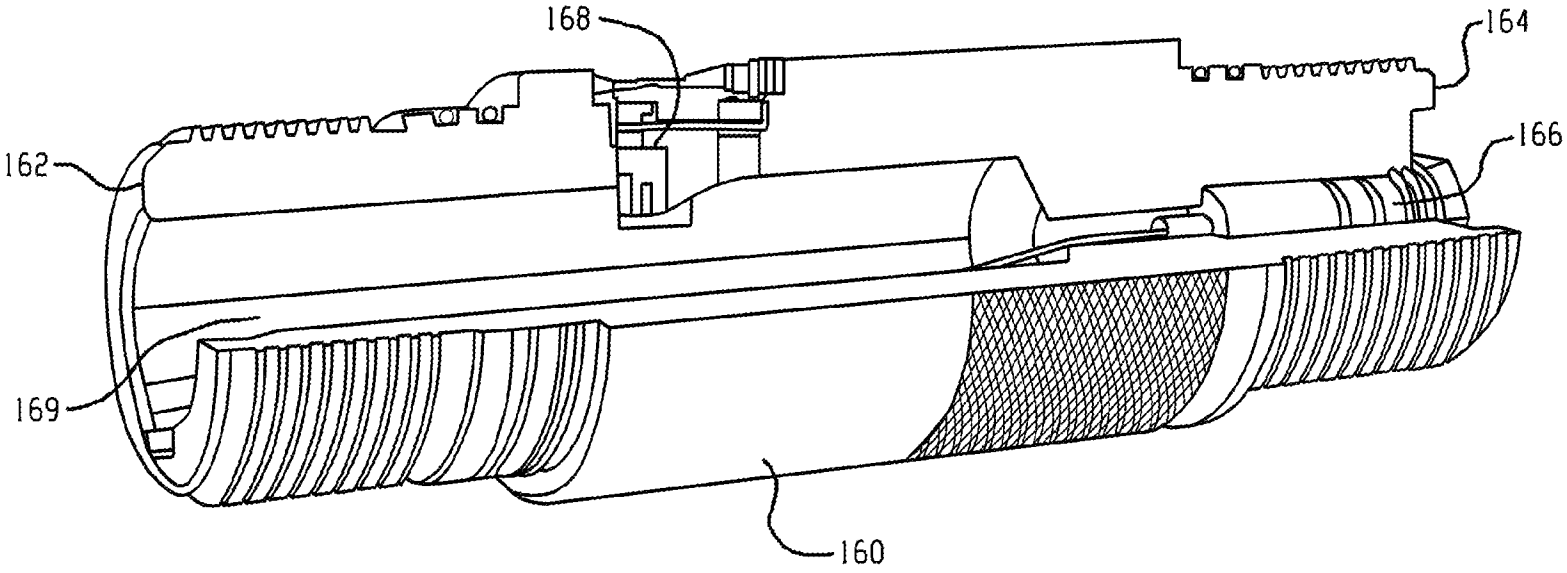
Fig. 1D PRIOR ART
FIG. 1D is a cutout view showing the interior and exterior of a conventional tandem sub.

Continuing, FIG. 1D shows a conventional tandem sub 160, which is used to join two perforating guns together. The tandem sub is also in the form of a cylindrical tube, and is usually of a shorter length than the charge carrier. A first end 162 of the tandem sub is open, while the second end 164 of the tandem sub is closed by an electrically conductive pin 166. A port 168 is also present on the side of the tandem sub, in the middle of the tandem sub. The port 168 and the first end 162 of the tandem sub are joined together by a passage 169 through the tandem sub. The passage is of sufficient size for an addressable switch (not illustrated) and detonator (not illustrated) to be placed within the tandem sub. The addressable switch is used to control the detonation of the charge carrier "above" the tandem sub. The through wire from the charge carrier "above" the tandem sub is stripped and tied to the electrically conductive pin on the second end of the tandem sub, to form an electrical connection to the charge carrier "below" the tandem sub. The two ends 162, 164 of the tandem sub also include external threads which are used to engage internal threads on the barrels that surround the charge carrier.

The inventive devices of the present disclosure include different end caps that can be used with a conventional charge carriers. Also included are tandem subs that can be used to transmit electrical signals using a pin-to-pin system. The end caps include various embodiments of a "bottom" end cap and a "top" end cap. Below, the end caps are first described, then the tandem sub is described, and then the system is described.

Figure 2B:
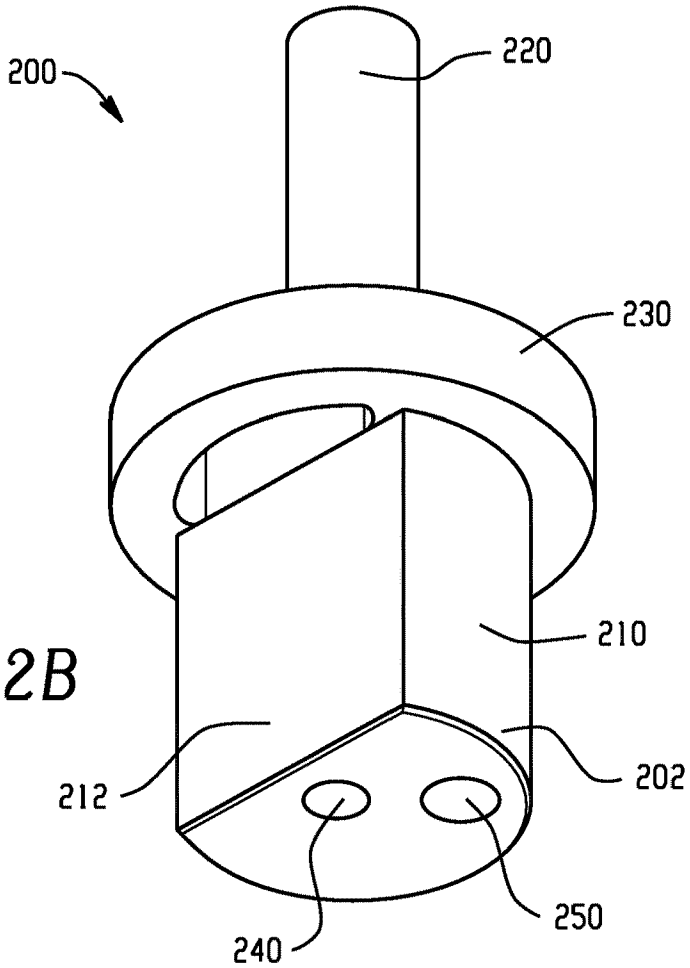
FIGS. 2A-2E are various views of a first embodiment of a "first" or "bottom" end cap of the present disclosure. This bottom end cap provides a location for the addressable switch to be placed.
Figure 2A:
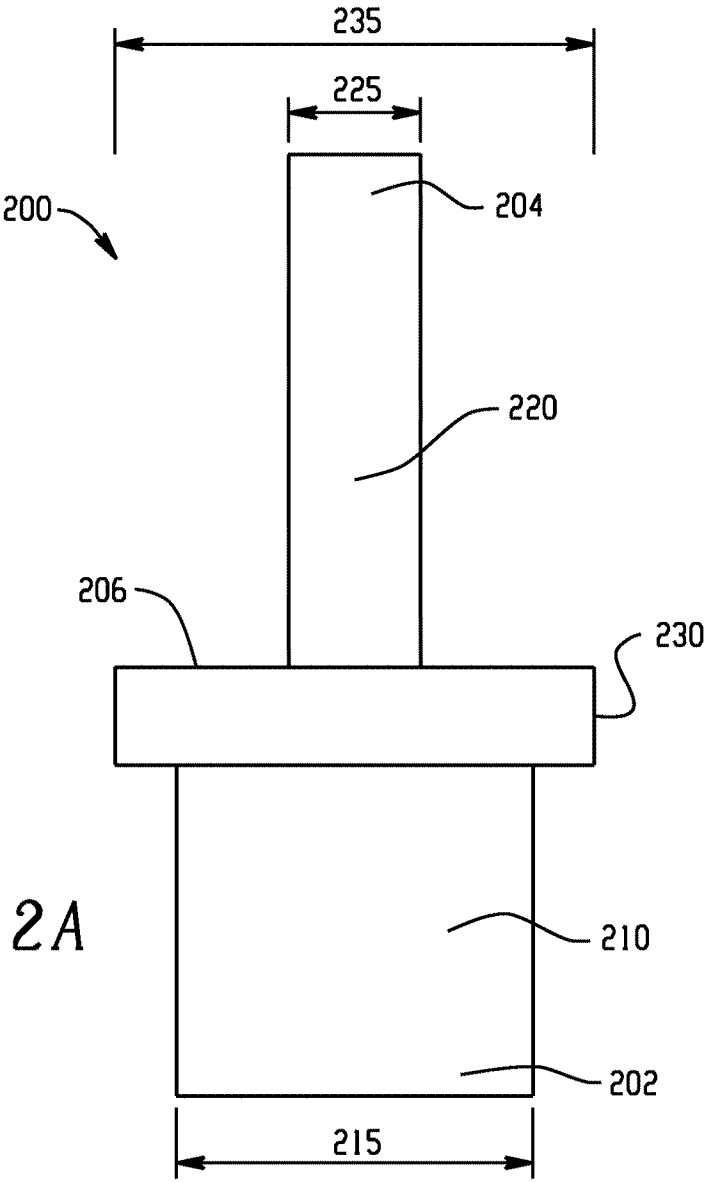
Figure 2E:
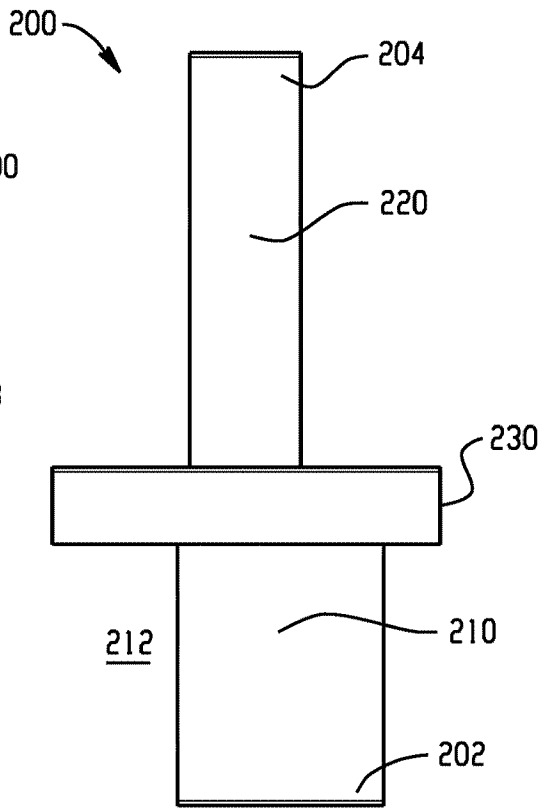
Figure 2D:
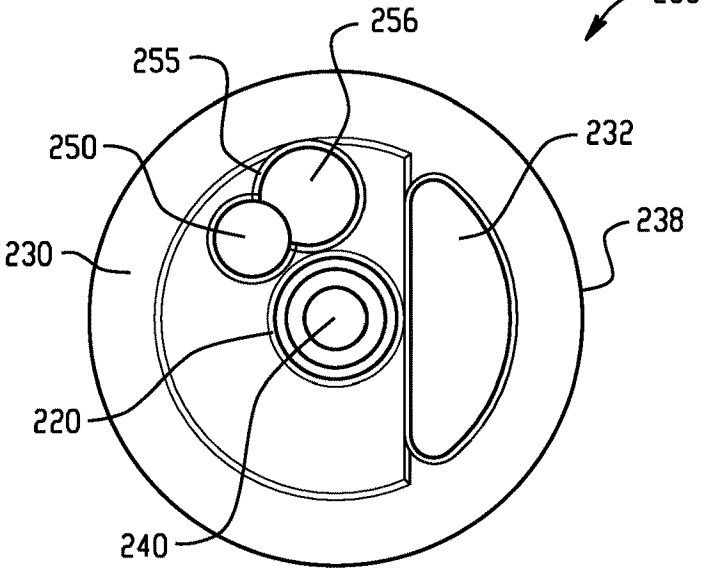
Figure 2C:
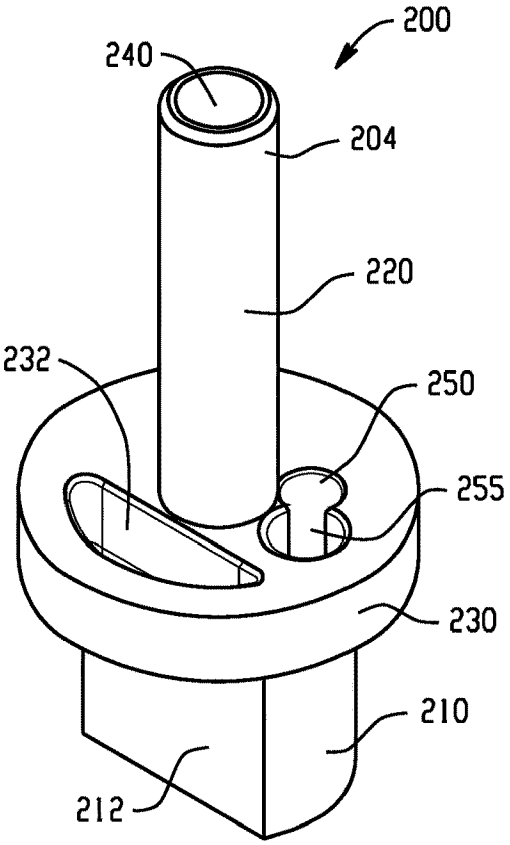

FIGS. 2A-2E are different views of a first end cap 200, or "bottom" end cap, of the present disclosure useful for permitting compatibility between an older charge carrier and a newer pin-to-pin tandem sub. FIG. 2A is a "front" view of the first end cap. FIG. 2B is a lower perspective view of the first end cap. FIG. 2C is an upper perspective view of the first end cap. FIG. 2D is a plan view of the first end cap. FIG. 2E is a side view of the first end cap.

Starting with FIG. 2A, the bottom end cap 200 is formed from a main body 210, a tube 220, and a collar 230. The main body 210 defines a first end 202 of the end cap. The tube 220 defines a second end 204 of the end cap. The collar 230 is located between the main body 210 and the tube 220, and forms a stop surface 206 that faces the second end of the end cap. The diameter 215 of the main body is less than the diameter 235 of the collar. The diameter 215 of the main body is greater than the diameter 225 of the tube. The diameter 235 of the collar is greater than the diameters 215, 225 of both the main body and the tube. The diameter 225 of the tube is less than the diameters 215, 235 of both the main body and the collar. The main body, the tube, and the collar can be considered to be cylindrical, with portions cut out or removed as described further herein.

As best seen in FIGS. 2B-2D, a shaft 240 passes through the center of the end cap and extends entirely from the first end 202 to the second end 204 of the end cap. This shaft 240 is aligned with the tube 220. A first hole 250 extends entirely through the collar 230 and the main body 210. A second hole 255 is located adjacent the first hole and extends through the collar 230 into the main body 210. The second hole 255 includes a stop surface 256, and is not visible at the first end as seen in FIG. 1B. The main body 210, the tube 220, and the collar 230 are all concentric about the shaft 240.

Continuing, as seen in FIGS. 2B-2E, the main body 210 includes a cutout 212 beyond a radius of the tube. The cutout could be described as removing a cylindrical segment from the main body. The collar 230 also has an opening 232 that is aligned with the cutout of the main body. However, it should be noted that the circumference/perimeter 238 of the collar as seen in FIG. 2D is still complete.

It is contemplated that in operation, the shaft 240 of this bottom end cap will also contain (i) a pin that extends outward from the first end of the bottom end cap, and (ii) an electrically conductive core at the second end of the bottom end cap that is electrically connected to the pin. Typically, a spring travels through the shaft 240 to electrically connect the core to the pin. The addressable switch is then wired to the pin. This will be illustrated further herein.

Figure 3C:
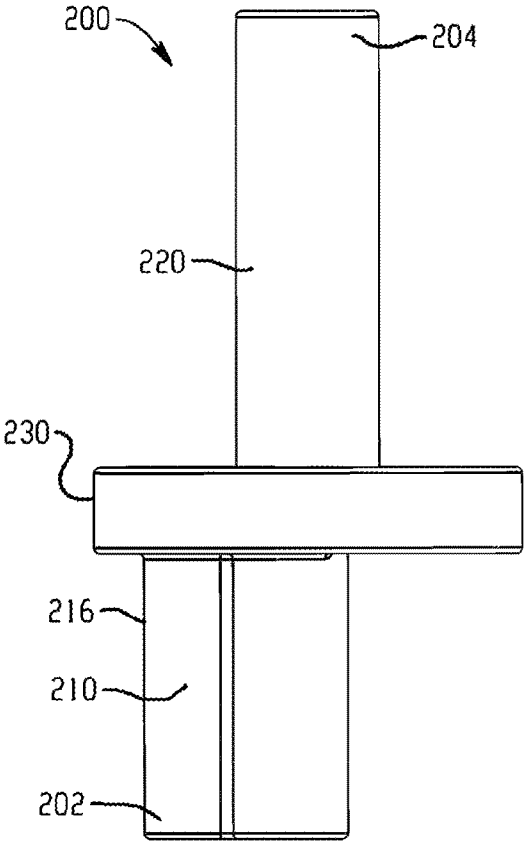
FIGS. 3A-3E are various views of a second embodiment of a bottom end cap of the present disclosure.
Figure 3B:
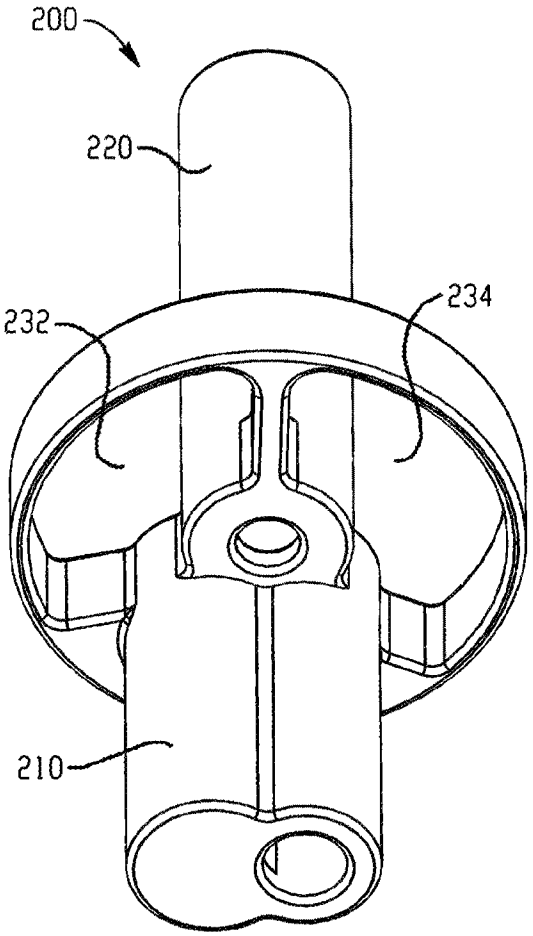
Figure 3A:
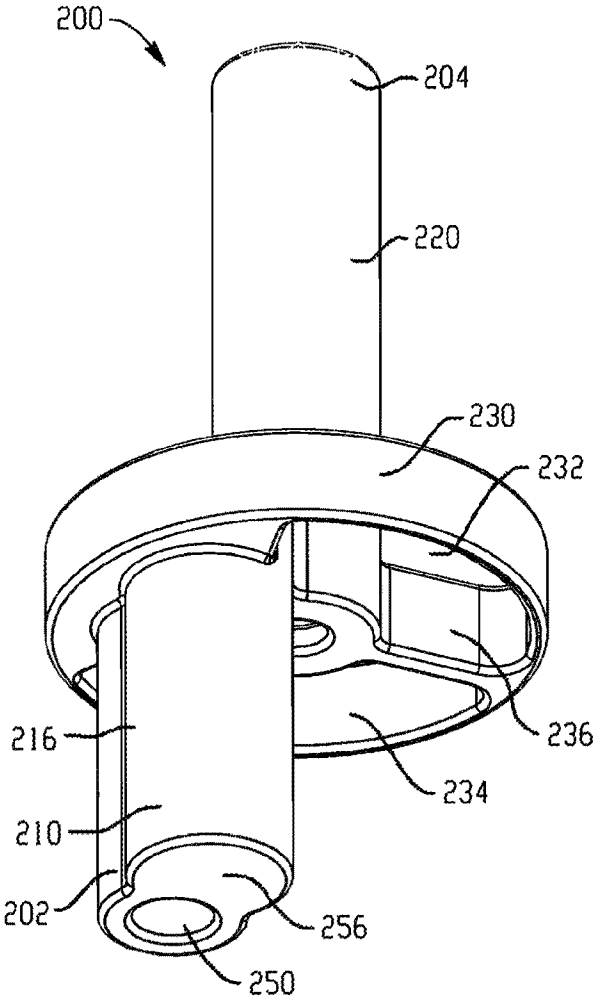
Figure 3D:
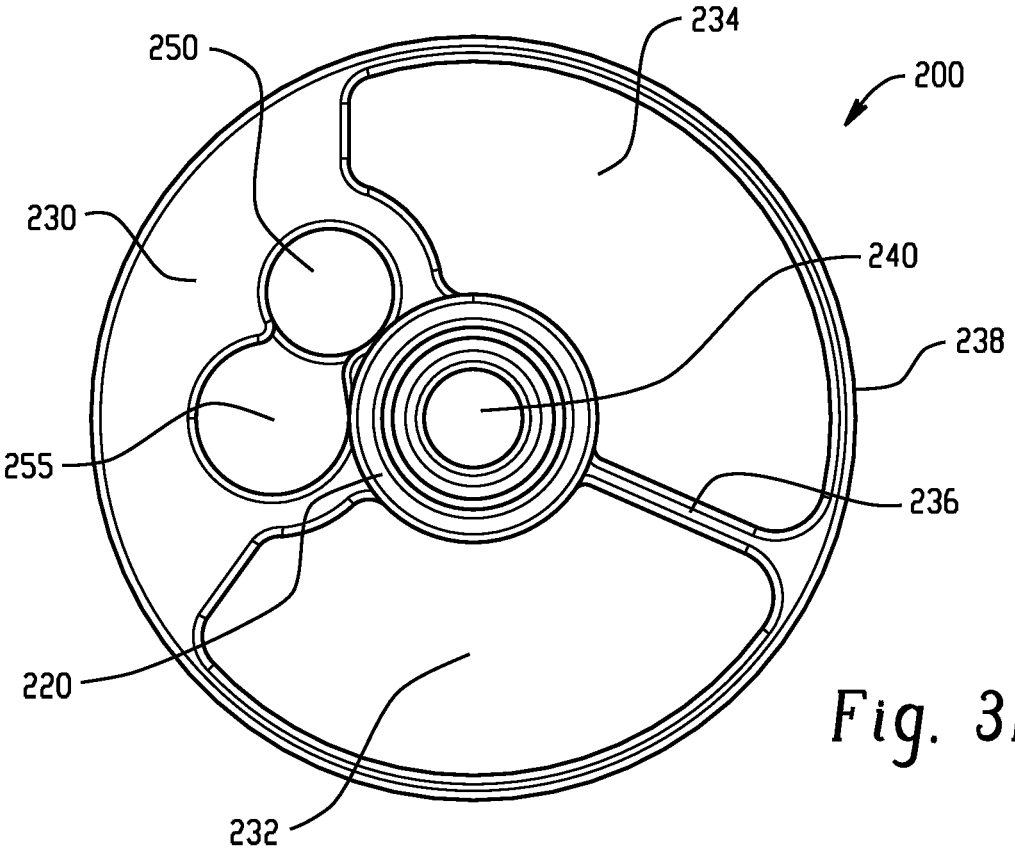
Figure 3E:
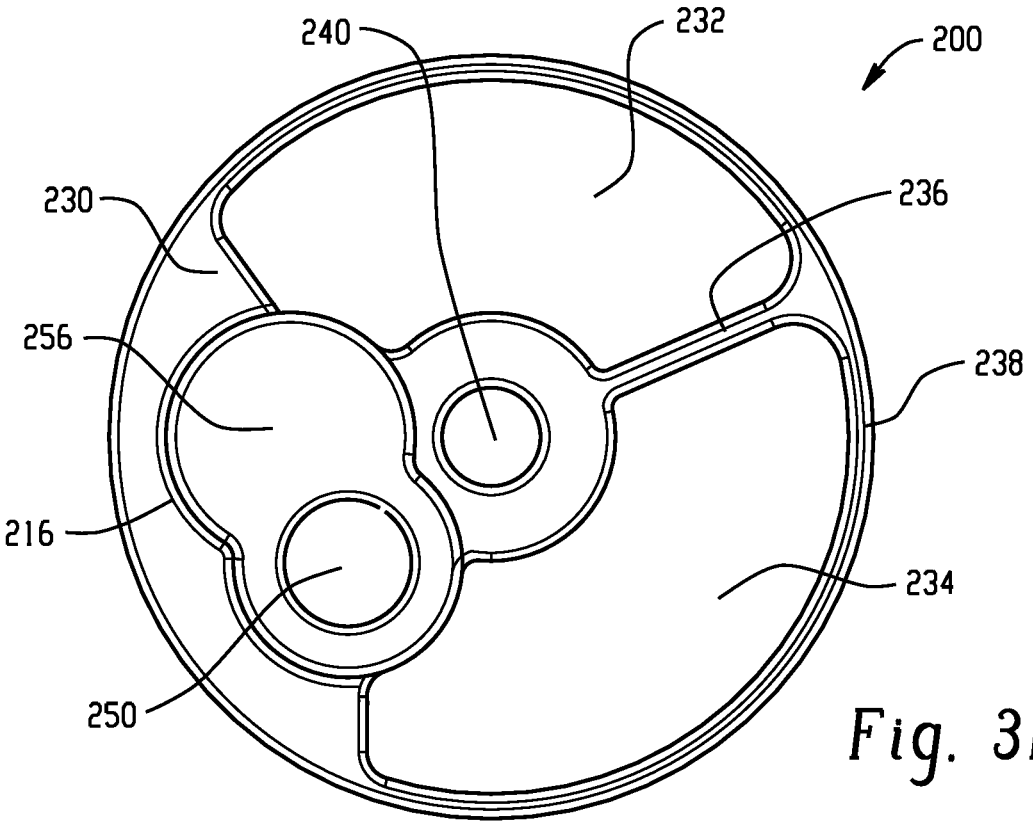

FIGS. 3A-3E are different views of a second embodiment of the bottom end cap. FIG. 3A is a first perspective view of the bottom end cap. FIG. 3B is a second perspective view of the bottom end cap, rotated around a central axis relative to FIG. 3A. FIG. 3C is a side view of the bottom end cap. FIG. 3D is a top view of the bottom end cap. FIG. 3E is a bottom view of the bottom end cap.

Referring to FIGS. 3A-3E, the main body 210, tube 220, and collar 230 of the bottom end cap 200 are shown. The main body 210 defines a first end 202 of the end cap. The tube 220 defines a second end 204 of the end cap. In this embodiment, the main body includes a sidewall 216 that could be described as surrounding the first hole 250 and the second hole 255. The second hole stop surface 256 is also visible.

The shaft 240 passes entirely through the tube 220 and the collar 230, but does not pass through the main body 210. The main body 210 is offset from the shaft 240. Put another way, the main body does not pass through the center axis of the end cap. The main body can be described as having the shape of two overlapping cylinders having parallel axes.

The solid volume of the collar 230 can be reduced, if desired. As seen here, the collar 230 can be described as having a first opening 232 and a second opening 234, which are separated by a support 236 that extends from the center to the perimeter 238 of the collar. These two openings 232, 234 are offset from the main body 210. Together, the two openings occupy an arc of at least 180° of the collar, and may occupy an arc of up to 260°, as measured from the center of the collar. Of course, these openings are optional. Only one opening may be present, or multiple supports could be used. Again, the circumference/perimeter 238 of the collar as seen in FIG. 3D is still complete.

Figure 4A:
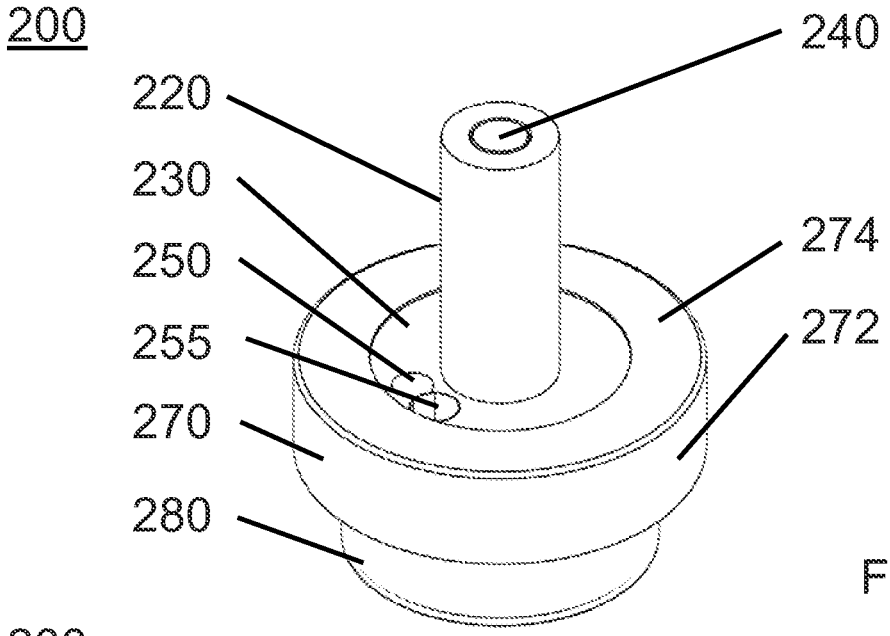
FIGS. 4A-4E are various views of a third embodiment of a bottom end cap of the present disclosure. This embodiment includes an addressable switch and one or two electrically conductive ground rings.
Figure 4B:
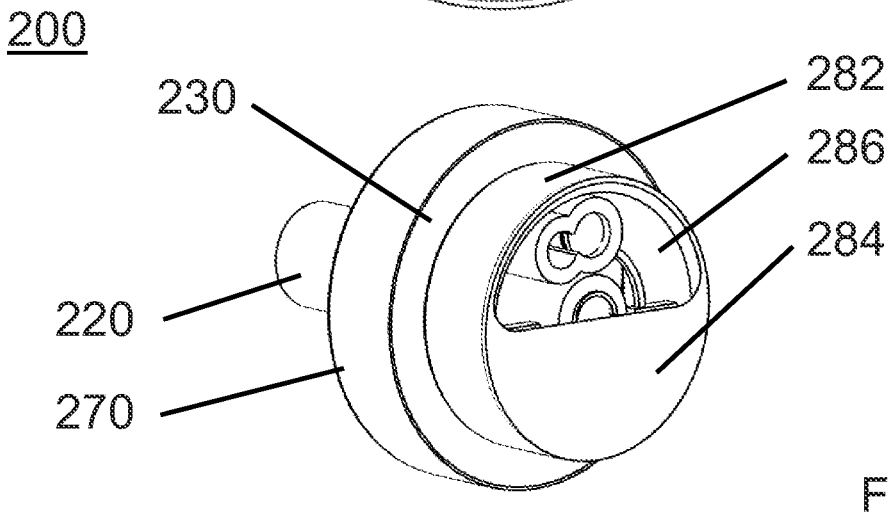
Figure 4C:
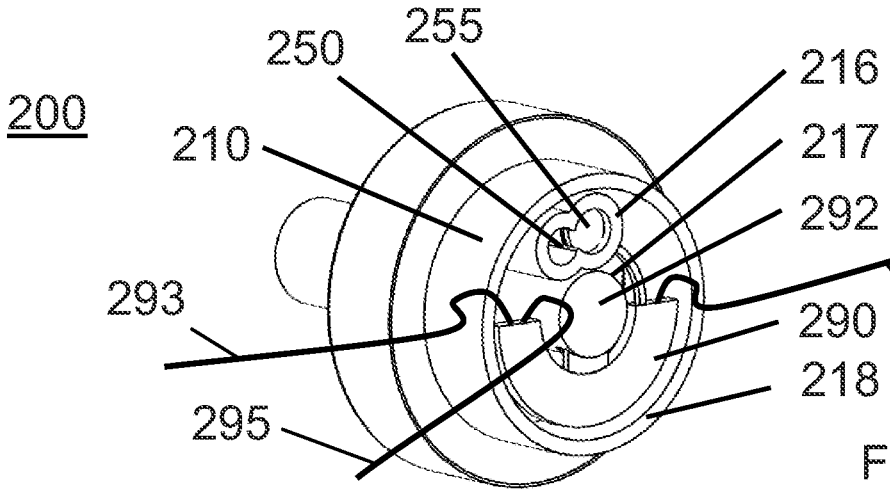
Figure 4D:
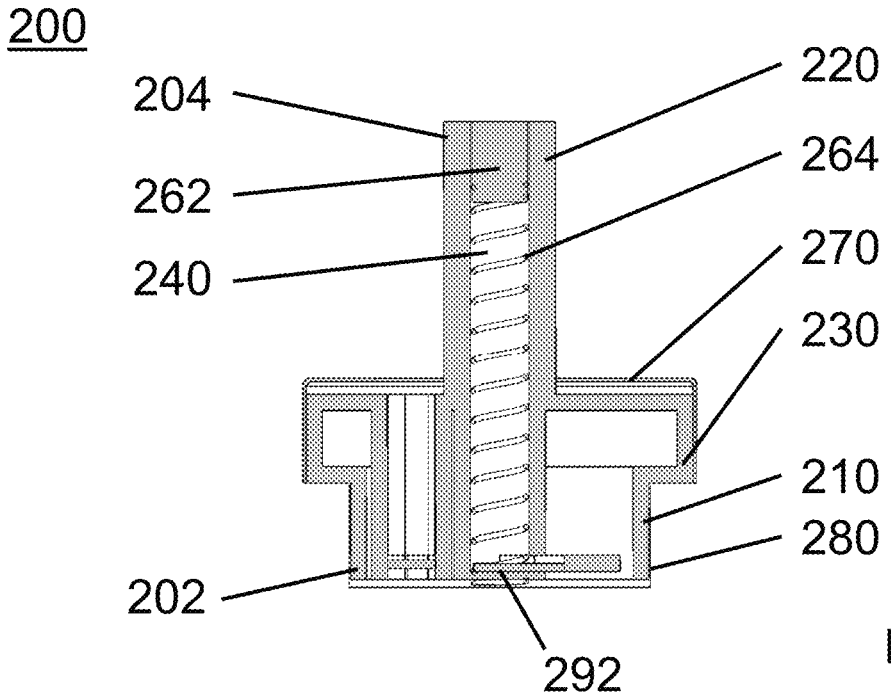
Figure 4E:
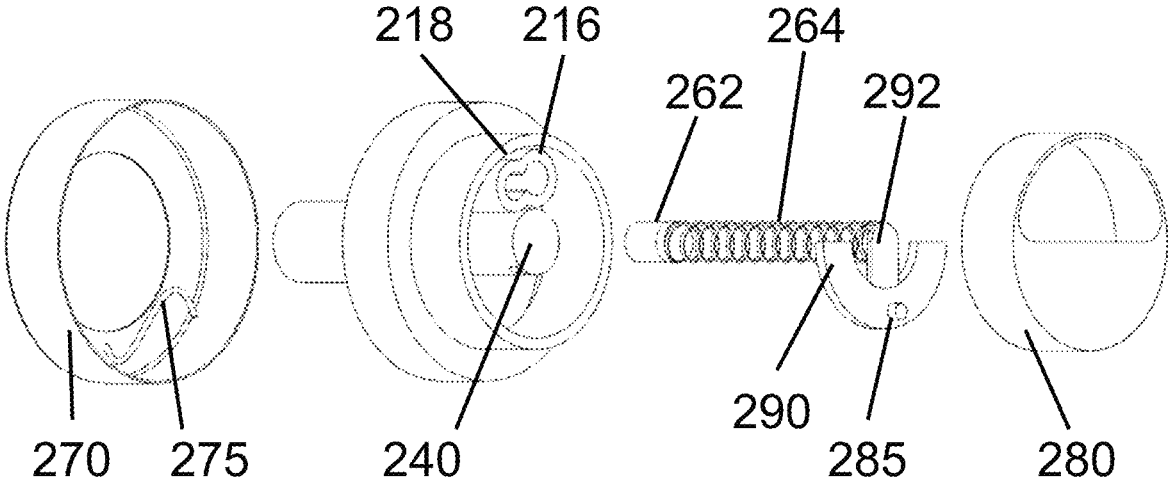

FIGS. 4A-4E are different views of a third embodiment of the bottom end cap, which includes an addressable switch integrated with the end cap, and can include one or two ground rings. FIG. 4A is an upper perspective view of the bottom end cap. FIG. 4B is a lower perspective view of the bottom end cap with a lower ground ring. FIG. 4C is a a lower perspective view of the bottom end cap with the lower ground ring removed. FIG. 4D is a side cross-sectional view of the bottom end cap. FIG. 4E is an exploded view.

Referring first to FIG. 4A, the tube 220 and the collar 230 are visible. The shaft 240, the first hole 250, and the second hole 255 are also visible. An upper ground ring 270 is located over the collar, and forms an outer surface around the perimeter/circumference of the end cap 200. The upper ground ring 270 is formed from a cylindrical sidewall 272 and a flat annular surface 274. The upper ground ring does not cover the first hole 250 or the second hole 255. A lower ground ring 280 is located around the main body, and also forms an outer surface. The upper ground ring and the lower ground ring are electrically conductive (e.g. metal), and are intended to act as a ground wire for the addressable switch.

Referring now to FIG. 4B, the lower ground ring 280 is formed from a cylindrical sidewall 282 and a flat surface 284. The flat surface includes a semicircular cutout 286. The lower surface of the collar 230 is also visible.

Referring now to FIG. 4C, the lower ground ring is removed to reveal the structure of the main body 210. A first inner sidewall 216 surrounds the first hole 250 and the second hole 255. An outer sidewall 218 forms a perimeter of the main body. The rest of the main body can be hollowed out to provide room for the addressable switch and other wiring, to reduce material usage, to reduce overall weight, etc. A second inner sidewall 217 which surrounds the shaft may be present at the center of the main body, although this second sidewall is optional. Without this second sidewall, the main body is very similar to that illustrated in FIG. 3A.

The addressable switch 290 is located within the main body. As illustrated here, the switch 290 has a flat semi-annular shape with an extension 292 that extends into the shaft 240. However, the switch 290 can take other shapes as well, so long as the switch fits within the main body.

The switch 290 is electrically connected/grounded to either the upper ground ring 270 or the lower ground ring 280. It is contemplated that the end cap 200 may have only the upper ground ring 270 present, or have only the lower ground ring 280 present, or have both the upper ground ring 270 and the lower ground ring 280 present. The ground rings are intended to contact another electrically conductive material, such as the charge carrier, which acts as a ground.

Referring now to the cross-sectional view of FIG. 4D, the main body 210, tube 220, collar 230, upper ground ring 270, and lower ground ring 280 are visible. The main body 210 defines a first end 202 of the end cap, and the tube 220 defines a second end 204 of the end cap. Located within the shaft 240 are an electrically conductive core 262 and a spring 264. The spring 264 biases the core 262 towards the second end 204 of the end cap. The core 262 is electrically connected to the extension 292 of the addressable switch, and acts as a through-wire to pass a signal from the switch through the core to a tandem sub. Here, the spring 264 is electrically conductive and so connects the core 262 to the addressable switch.

Generally speaking, there is a hollow portion or pocket within the main body into which the addressable switch 290 can be fitted, and the addressable switch can be of any shape, so long as the addressable switch can be electrically connected to the 262 and a ground ring 270, 280. The addressable switch can be fixed in place within the main body, for example, by ultrasonic welding, or by screwing it in, or using screws or other fasteners to attach it to supports in the main body. Alternatively, an electrically insulating resin could be poured around the addressable switch to encase and fix it in place within the main body.

Referring now to FIG. 4E, various components are visible. The first inner sidewall 216 surrounding the first hole and second hole can be seen within the outer sidewall 218. The shaft 240 is surrounded by a second inner sidewall 217. The core 262 is connected to a spring 264, which is connected to the extension 292 of the addressable switch 290. Two different methods for grounding the addressable switch are illustrated here (of course, using only one is sufficient). First, a ground wire 275 could be used to electrically connect the upper ground ring 270 to the addressable switch 290. Second, a spring or pin 285 could be used to electrically connect the lower ground ring 280 to the addressable switch 290. Other similar structures could also be used.

It is noted that the upper ground ring 270 and the lower ground ring 280 could also be used with the bottom end cap illustrated in FIG. 2A or FIG. 3A.

A conventional addressable switch has five wires: a positive contact and a negative contact to the detonator, a "bottom" and a "top" through-wire, and a ground wire. The addressable switch 290 is still electrically connected to a positive contact wire 293, a negative contact wire 294, and a top through-wire 295 see FIG. 4C), which are used for their known purpose. It is contemplated that such wires could extend from the main body 210 (i.e. out the first end of the end cap), for example through the semicircular cutout 286 of the lower ground ring.

Referring back to FIGS. 1A-1C, the bottom end cap 200 described above in various embodiments can be used to replace one of the end plates 112, 114 on a conventional charge carrier 100. In the embodiment of FIG. 2A, the cutout 212 in the main body and the aligned opening 232 in the collar provide a spot for placing/storing the addressable switch. In the embodiment of FIG. 3A, it is contemplated that the addressable switch is held in place in an opening 232, 234. In the embodiment of FIG. 4C, the addressable switch is fixed in place within the main body 210. In all of these embodiments, the detonator cord passes through the first hole 250, and the detonator is placed in the second hole 255.

Figure 5A:
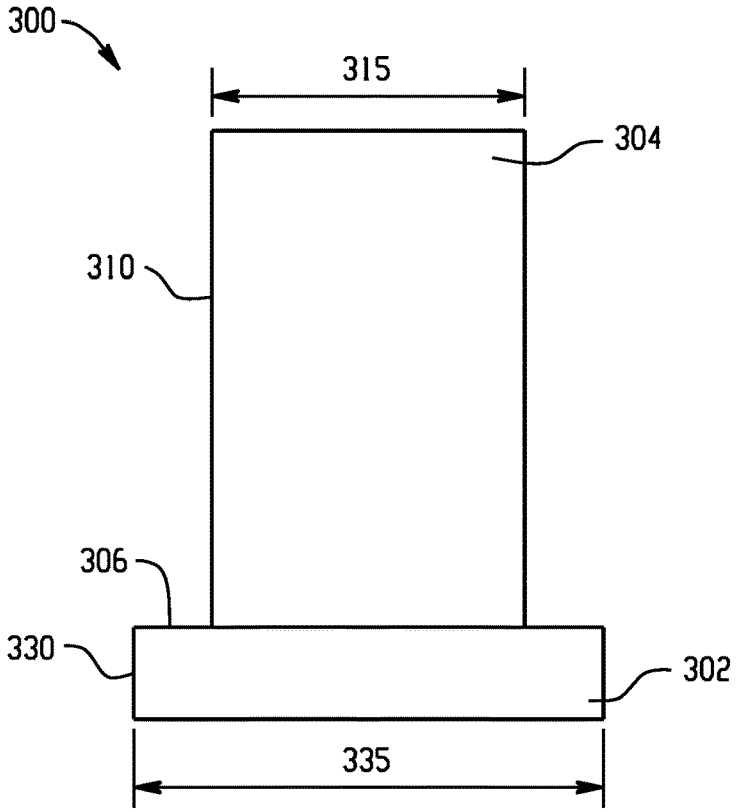
FIGS. 5A-5D are various views of a "second" or "top" end cap of the present disclosure. This top end cap provides an electrical pathway for downstream devices.
Figure 5B:
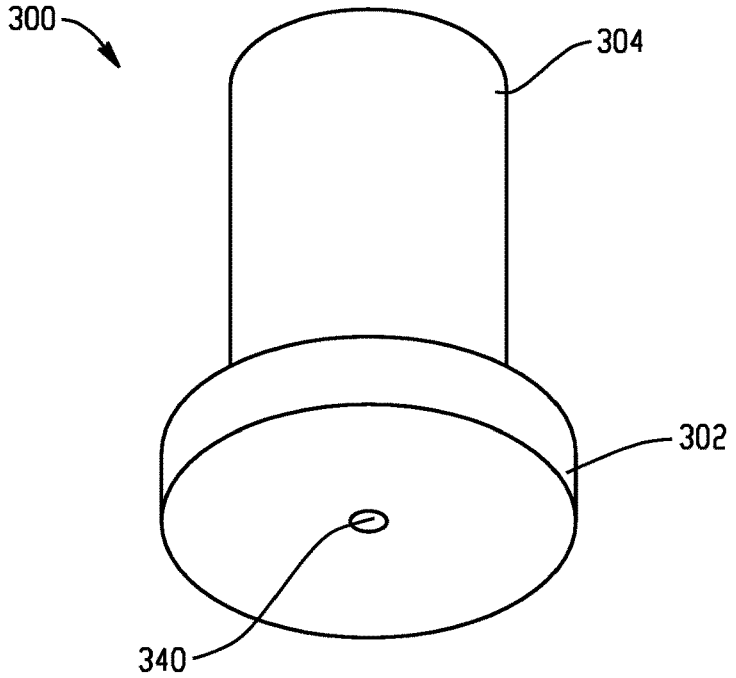
Figure 5C:
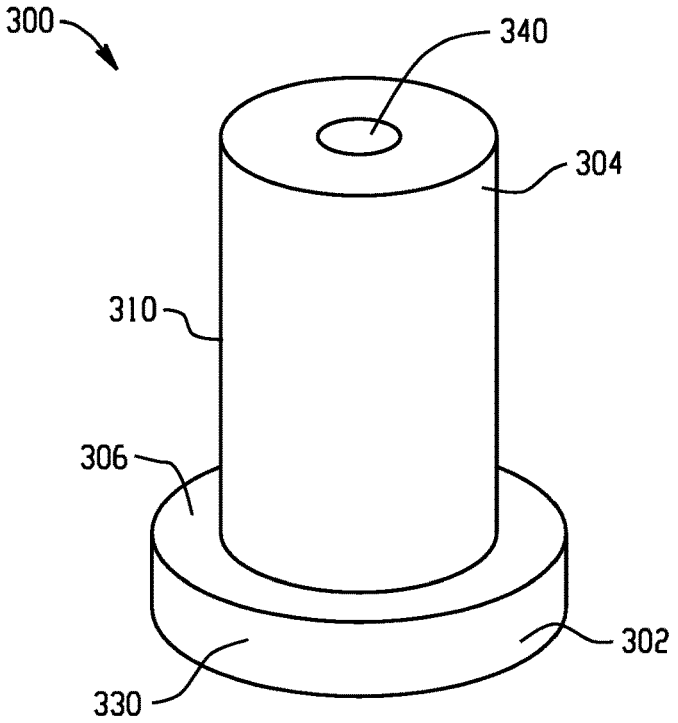
Figure 5D:
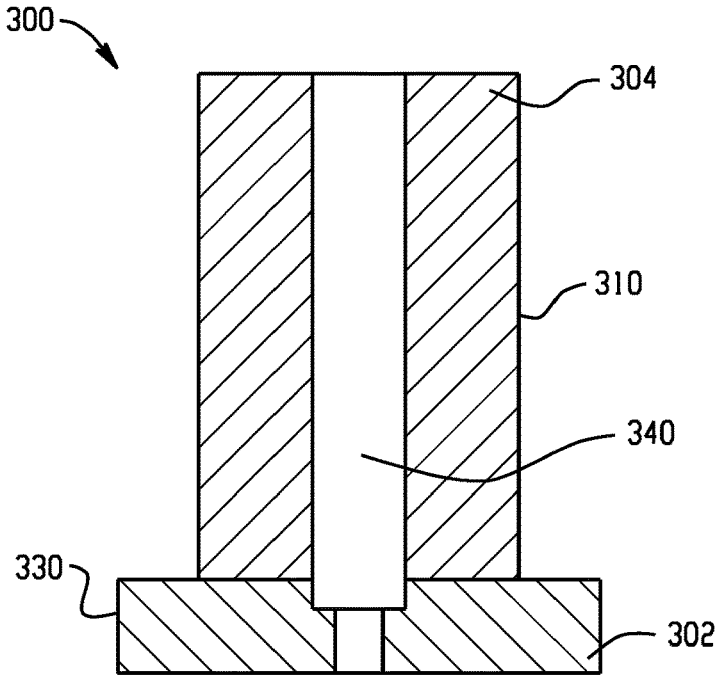

Continuing, FIGS. 5A-5D are different views of a second end cap, or "top" end cap, of the present disclosure that is also used (along with a bottom end cap) to promote compatibility between an older charge carrier and a new pin-to-pin tandem sub. FIG. 5A is a "front" view of the top end cap. FIG. 5B is a lower perspective view of the top end cap. FIG. 5C is an upper perspective view of the top end cap. FIG. 5D is a cross-sectional view of the top end cap.

Starting with FIG. 5A, the top end cap 300 includes a main body 310 and a collar 330. The top end cap does not include a tube as is present in the bottom end cap. The collar 330 defines a first end 302 of the end cap, and forms a stop surface 306. The main body 310 defines a second end 304 of the end cap. The diameter 315 of the main body is less than the diameter 335 of the collar. The main body and the collar can be considered to be cylindrical, with portions cut out or removed as described further herein. The main body and the collar are also concentric.

As best seen in FIGS. 5B-5D, a shaft 340 passes through the center of the end cap and extends entirely from the first end 302 to the second end 304 of the end cap. As seen in FIG. 5D, the opening of the shaft at the first end (i.e. the collar) is smaller than the opening of the shaft at the second end (i.e. the main body), or put another way has a smaller diameter at the first end.

Referring also to FIG. 5D, it is contemplated that in operation, the shaft of the top end cap will also contain (i) a pin that extends outward from the first end of the top end cap, and (ii) an electrically conductive core at the second end of the top end cap that is electrically connected to the pin. Typically, a spring travels through the shaft to electrically connect the core to the pin.

The top end cap can be used to replace the other end plate on a conventional charge carrier. One end of the through wire is wired to the pin of the top end cap.

Figure 6A:
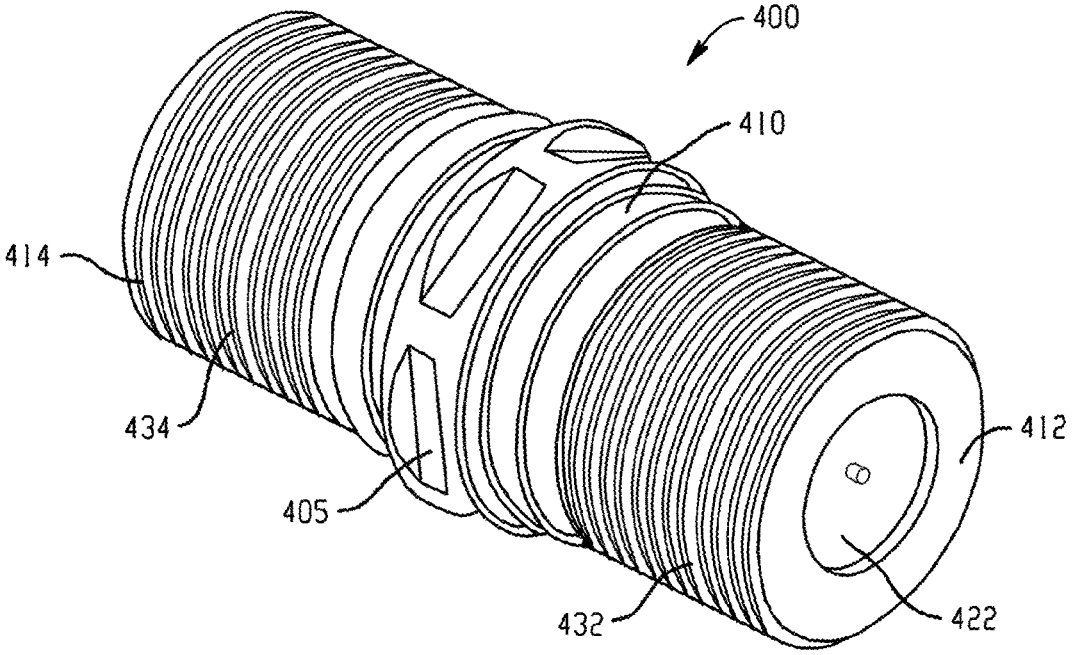
FIGS. 6A-6D are various views of a first embodiment of a pin-to-pin tandem sub of the present disclosure.
Figure 6B:
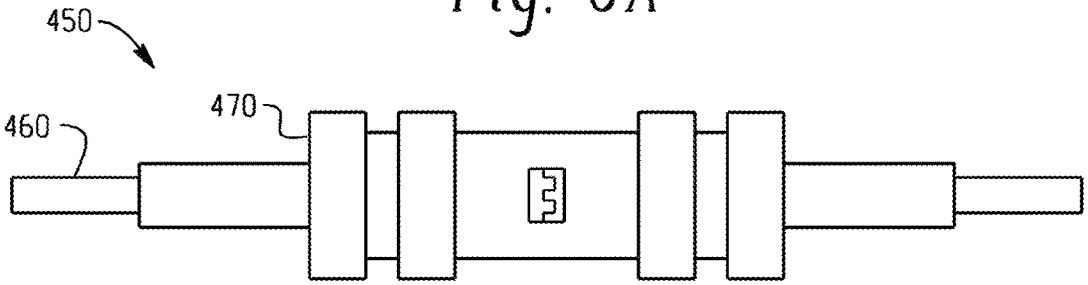
Figure 6C:
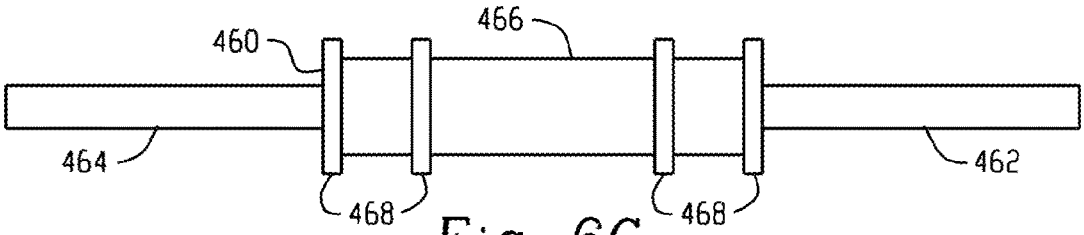
Figure 6D:
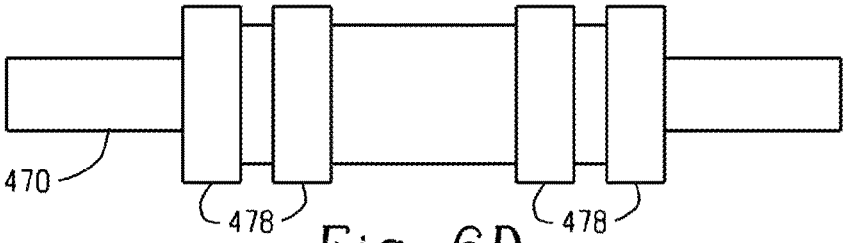

Next, the new tandem subs of the present disclosure are described. FIG. 6A is an exterior view of a first embodiment of a tandem sub 400 according to the present disclosure that uses a "pin-to-pin" connection. FIGS. 6B-6D are various views of the electrically-conductive through-pin 450 located within the pin-to-pin tandem sub.

Referring first to FIG. 6A, the sub 400 comprises a main body 410 having a first end 412 and a second end 414. Each end 412, 414 also includes a box 422, 424, which can be described as an indented area into which an end cap can be inserted, as described later. An external thread 432, 434 is present on the outer surface of the main body at both the first end and at the second end. The central portion 405 of the outer surface of the main body 410 can be knurled or otherwise textured to improve grip. Notably, no port is present that would form a passage, and neither of the ends can be described as open.

FIGS. 6B-6D are various views of the electrically-conductive through-pin 450, which is located within the pin-to-pin tandem sub, but made separately from the tandem sub. FIG. 6B shows the through-pin itself. The through-pin 450 is formed from an electrically-conductive rod 460 and an non-electrically conductive jacket 470. The rod 460 is shown in FIG. 6C, and the jacket 470 is shown in FIG. 6D.

Referring first to FIG. 6C, the rod 460 is solid, and is made of an electrically conductive material (e.g. metal). The rod has a first end 462 and a second end 464 at opposite ends of the rod. The central portion 466 of the rod has a greater diameter than the ends of the rod, and also contains four shoulders 468 (although only the outer two shoulders are necessary), two located relatively closer to each end. Referring now to FIG. 6D, the non-electrically conductive jacket 470 surrounds the central portion 466 of the rod itself, with the two ends 462, 464 of the rod remaining exposed. The jacket also has four shoulders 478, which are aligned with the shoulders 468 of the rod. The outer two shoulders of the jacket act as a stop surface for the nuts 442, and have a larger diameter than the rod.

Figure 7:
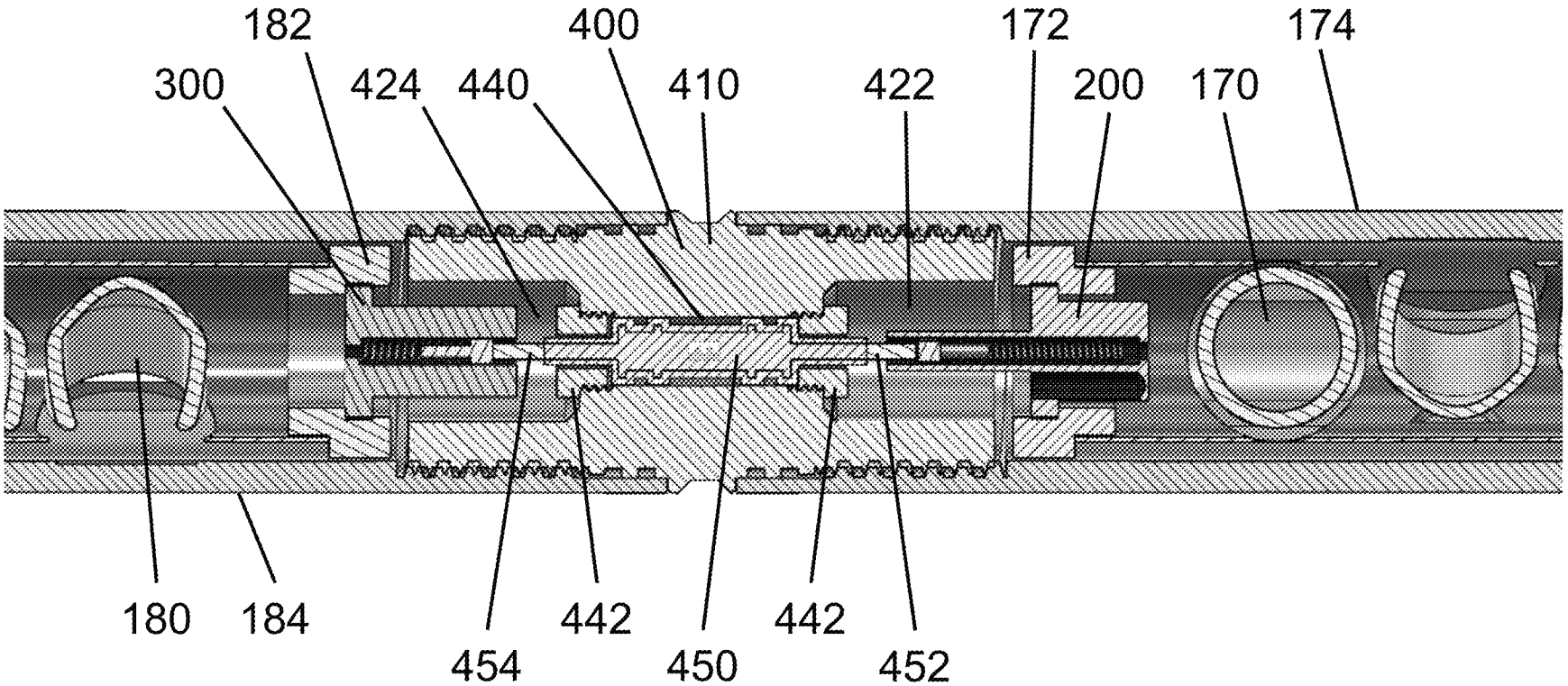
FIG. 7 is a cross-sectional view showing the two end caps engaged with the pin-to-pin tandem sub.

FIG. 7 is a cross-sectional view showing an assembly of two charge carriers 170, 180 joined together using a pin-to-pin tandem sub 400 and the two end caps 200, 300.

As an overview, the bottom end cap 200 and the top end cap 300 are depicted as engaging the pin-to-pin tandem sub 400. On the right-hand side, the bottom end cap 200 engages an end plate 172 of first charge carrier 170. The first charge carrier 170 is surrounded by first barrel 174. On the left-hand side, the top end cap 300 engages an end plate 182 of second charge carrier 180. The second charge carrier 180 is surrounded by second barrel 184. The pin-to-pin tandem sub 400 joins the two barrels 174, 184 together.

Referring now to the tandem sub 400, a shaft 440 extends entirely through the main body 410 from the first end to the second end. The electrically-conductive through-pin 450 is fixed in place within the shaft. The shaft 440 has the same diameter at both ends. The ends 452, 454 of the through-pin are exposed at the first end and the second end of the main body. A first end 452 of the through-pin is present within the box 422 at the first end of the main body. A second end 454 of the through-pin is present within the box 424 at the second end of the main body. The through-pin 450 is fixed in place by nuts 442 that secure the through-pin at each end. The ends 452, 454 of the through-pin engage the bottom end cap 200 and the top end cap 300 located within the two charge carriers 170, 180 and permit an electrical signal to be passed between the two charge carriers.

Figure 8A:
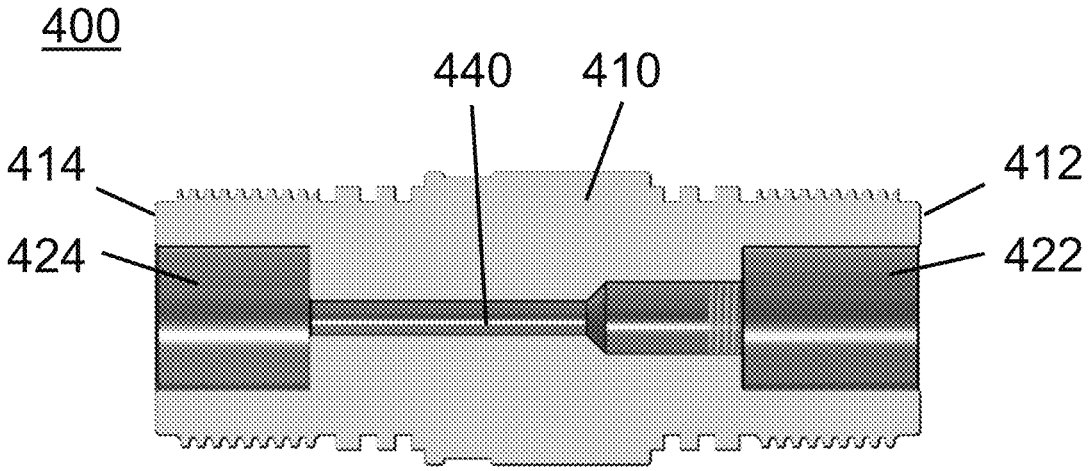
FIG. 8A is an exterior view of a second embodiment of a tandem sub 400 according to the present disclosure that uses a "pin-to-pin" connection.
Figure 8B:
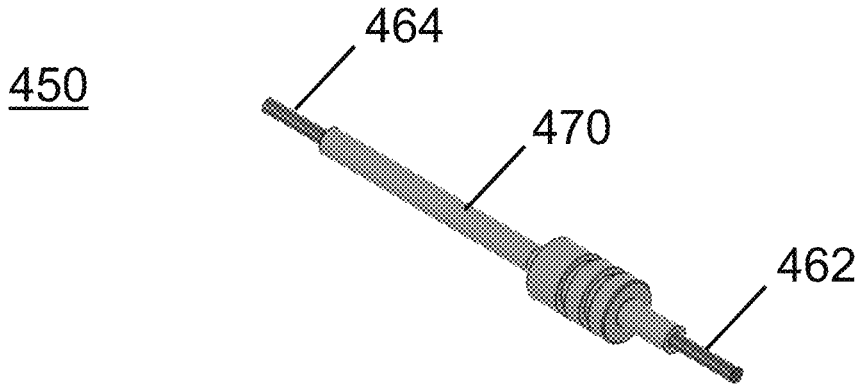
FIGS. 8B-8D are various views of a first structure for an electrically-conductive through-pin located within the pin-to-pin tandem sub.
Figure 8C:
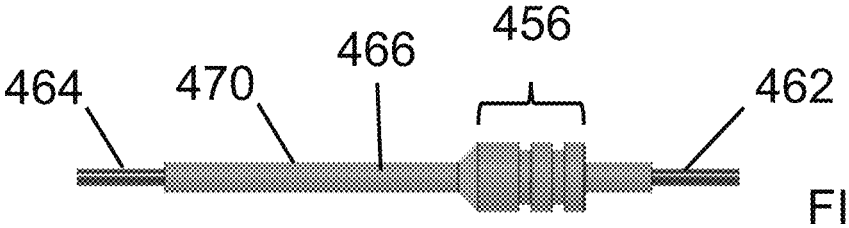
Figure 8D:
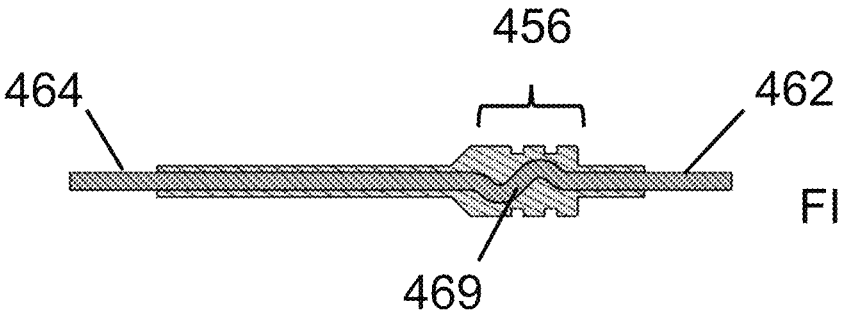
Figure 8E:
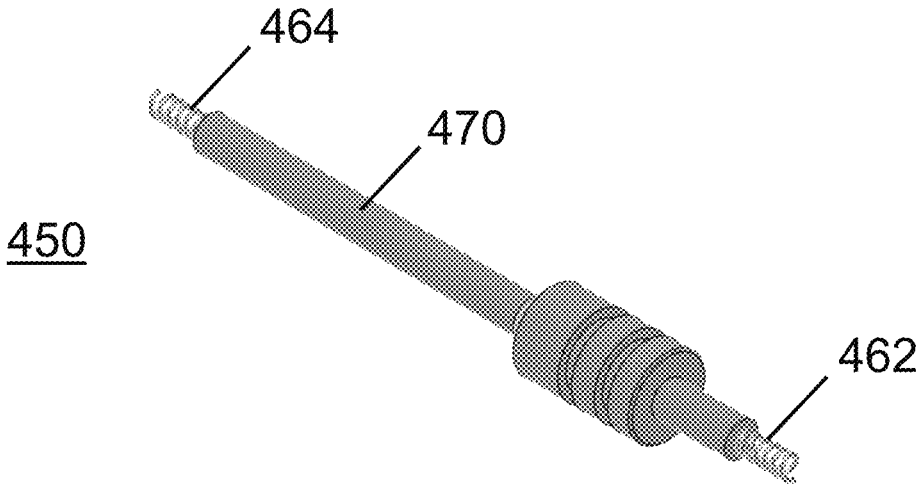
FIGS. 8E-8G are various views of a second structure for an electrically-conductive through-pin located within the pin-to-pin tandem sub.
Figure 8F:
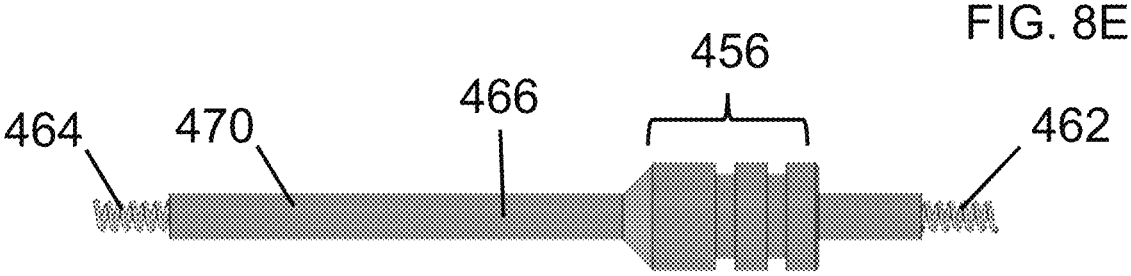
Figure 8G:
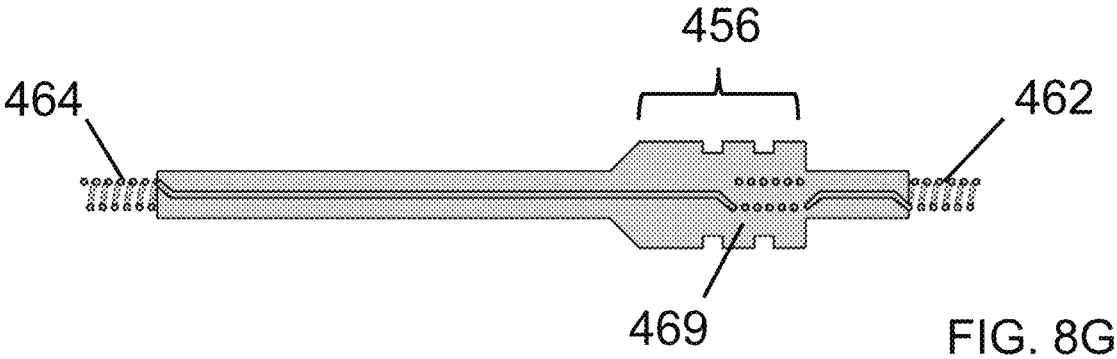

Continuing, FIG. 8A is an exterior view of a second embodiment of a tandem sub 400 according to the present disclosure that uses a "pin-to-pin" connection. FIGS. 8B-8D are various views of a first structure for an electrically-conductive through-pin 450 located within the pin-to-pin tandem sub. FIGS. 8E-8G are various views of a second structure for an electrically-conductive through-pin 450 located within the pin-to-pin tandem sub.

Referring now to FIG. 8A, the shaft 440 extends entirely through the main body 410 from the first end 412 to the second end 414. Boxes 422, 424 are present at each end. However, the shaft 440 is narrower (i.e. has a smaller diameter) at the second end 414 compared to the first end 412. Thus, only one nut is needed to fix the electrically-conductive through-pin in place.

FIGS. 8B-8D show a first structure for the electrically-conductive through-pin 450 located within the tandem sub. FIG. 8B is a perspective view. FIG. 8C is a side view. FIG. 8D is a side cross-sectional view.

Referring first to FIG. 8B and FIG. 8C, the rod 460 is in the form of a solid wire, and is made of an electrically conductive material (e.g. metal). The rod has a first end 462 and a second end 464 visible at opposite ends of the rod. A non-electrically conductive jacket 470 surrounds the central portion 466 of the rod itself, with the two ends 462, 464 of the rod remaining exposed. The through-pin itself has one shoulder 456 located relatively close to the first end 462 of the rod (i.e. not in the center of the through-pin). The shoulder has a greater diameter than the rest of the through-pin. Compared to the through-pin of FIG. 6B, which has shoulders on both ends, this through-pin only has a shoulder on one end.

Referring now to FIG. 8D, it can be seen that the wire of the rod 460 is bent in a location 469 corresponding to the shoulder 456, to have a larger diameter. The bend can be two-dimensional (i.e. within a plane) or three-dimensional (e.g. a small helix). Otherwise, the solid wire is straight. This bend enhances physical joinder of the rod 460 to the jacket 470.

FIGS. 8E-8F show a second structure for the electrically-conductive through-pin 450 located within the tandem sub. FIG. 8E is a perspective view. FIG. 8F is a side view. FIG. 8G is a side cross-sectional view.

Referring first to FIG. 8E and FIG. 8F, the rod 460 is made from a relatively thinner wire than that shown in FIG. 8B. The rod has a first end 462 and a second end 464 visible at opposite ends of the rod. At each end, the wire has been coiled, so that these ends are in the form of a spring. A non-electrically conductive jacket 470 surrounds the central portion 466 of the wire itself, with the two ends 462, 464 of the rod remaining exposed. The through-pin again has one shoulder 456 located relatively close to the first end 462 of the rod (i.e. not in the center of the through-pin). The shoulder has a greater diameter than the rest of the through-pin.

Referring now to FIG. 8G, it can be seen that the wire of the rod 460 is also coiled into the form of a spring at a location 469 corresponding to the shoulder 456, to have a larger diameter. This is an example of the bend having a three-dimensional form. The remainder of the wire is straight beyond these three coiled locations Referring back to FIG. 8A, then the through-pins of FIG. 8B and FIG. 8E are inserted into the shaft 440 from the first end 412. The thinner part of the through-pin 450 passes through to the second end 414. The shoulder 456 stops the travel of the through-pin towards the second end. A single nut (not illustrated) also engages the shoulder 456, to hold the through-pin 450 in the shaft 440.

It is noted that the pin-to-pin tandem sub 400 of FIG. 6A and FIG. 8A is not compatible by itself with the conventional charge carrier 100 of FIG. 1A. This is because the conventional tandem sub 160 seen in FIG. 1D provided a location for the addressable switch, and there is no longer such a location for the addressable switch in the pin-to-pin tandem sub. The conventional charge carrier of FIG. 1A also is not configured to provide a location for the addressable switch. Thus, the two new end caps 200, 300 must be used with the pin-to-pin tandem sub 400, as shown in FIG. 7.

Figure 9:
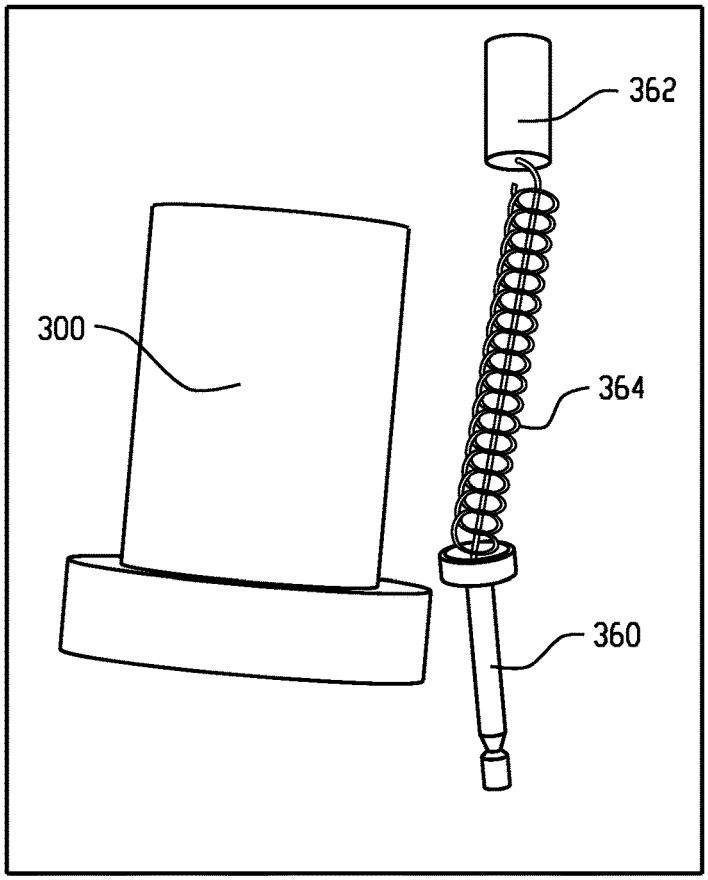
FIG. 9 is a picture of a top end cap, along with components internal to a shaft thereof.
Figure 10:
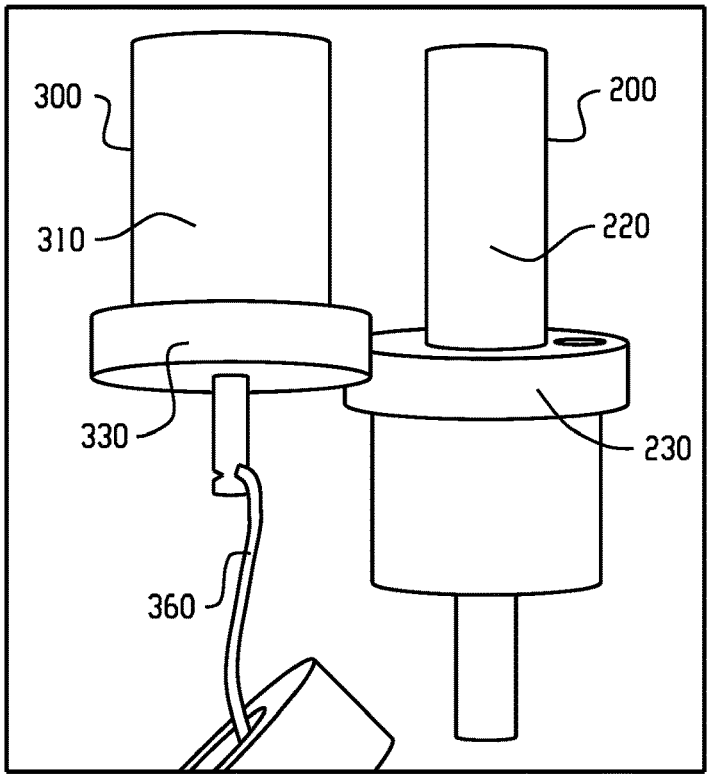
FIG. 10 is a picture showing a bottom end cap next to a top end cap for purposes of comparison.

FIG. 9 and FIG. 10 are pictures of actual end caps made according to the present disclosure.

FIG. 9 is a picture of a top end cap 300, as previously illustrated in FIG. 5A. Also shown next to the second end cap is a pin 360, core 362, and spring 364. These components would be be inserted into the shaft of the second end cap. It is noted that after the pin, core, and spring are inserted into the shaft, the end of the main body can be melted and/or bent to hold these components within the shaft.

FIG. 10 is a picture showing the bottom end cap 200 (right) next to the top end cap 300 (left). In this regard, it is noted that the tube 220 of the bottom end cap has an axial length that is substantially the same as the axial length of the main body 310 of the second end cap. This is because the collars 230, 330 of both end caps engage the end plate of the charge carrier (see FIG. 1A). The tube of the bottom end cap and the main body of the top end cap then extend outwards from the end plate of the charge carrier, and engage the pin-to-pin tandem sub. The pin 360 is visible extending from the top end cap. The pin is wired to a separate addressable switch.

Now, referring back to FIG. 9, electricity is conducted through the bottom end cap and the top end cap via an assembly of pin 360, core 362, and spring 364. A second version of the assembly can also be used which requires only a second version of the core and a spring, eliminating the need for the pin.

Figure 11A:
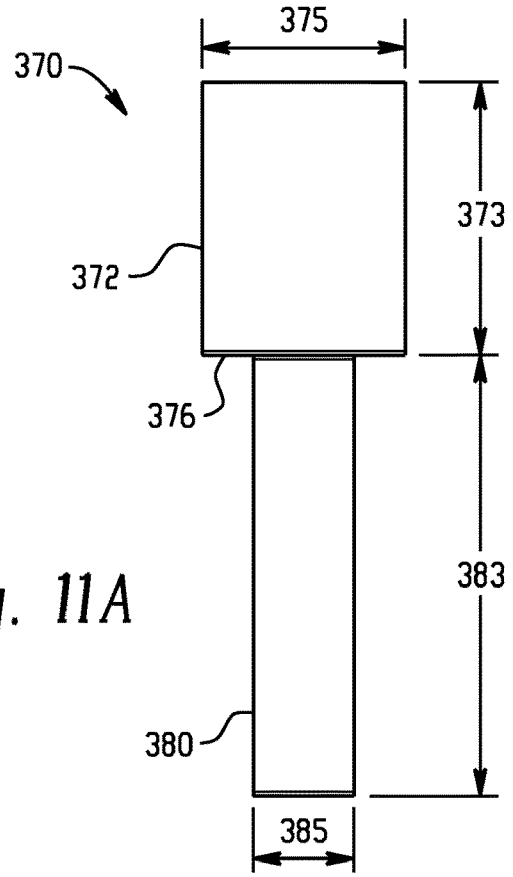
FIGS. 11A-11C are various views of a second version of a core that can be used with the end caps of the present disclosure. This core removes the need for a pin.
Figure 11B:
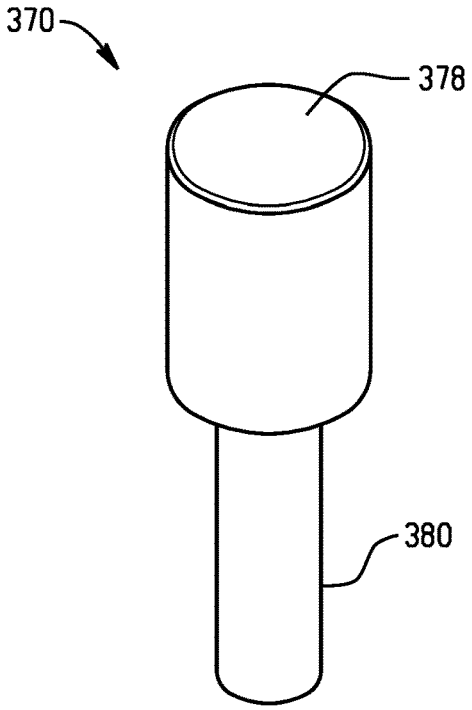
Figure 11C:
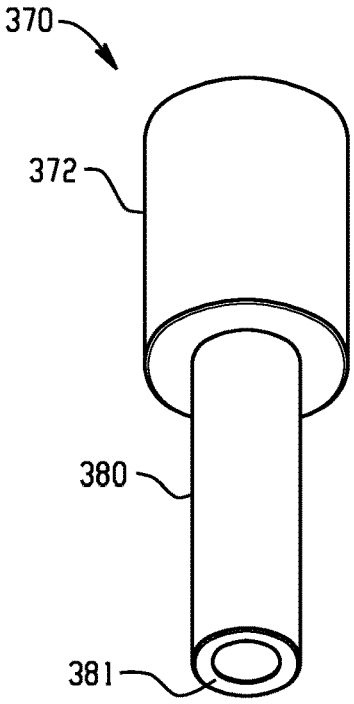

FIGS. 11A-11C are various views of the second version of the core that can be used with the end caps of the present disclosure. This second version of the core removes the need for a pin. FIG. 11A is a side view of the core. FIG. 11B is an upper perspective view of the core. FIG. 11C is a lower perspective view of the core.

Referring first to FIG. 11A, the core 370 includes a head 372 and a tail 380. The head 372 has a length 373 and a diameter 375. The tail 380 also has a length 383 and a diameter 385. The diameter 375 of the head is greater than the diameter 385 of the tail, and its bottom surface 376 acts as a stop surface for the spring (not depicted). The tail 380 is surrounded by the spring. As illustrated here, the length 383 of the tail is greater than the length 373 of the head. However, this is not essential for its operation, as will be explained further below.

As seen in FIG. 11B, the top surface 378 of the head is solid, and will interact with the pin-to-pin tandem sub of FIG. 6A. As seen in FIG. 11C, the tail 380 is formed from a cylindrical sidewall 381 that surrounds a tubular volume, or in other words the tail is hollow. The head 372 can be solid or hollow, as desired.

It is contemplated that the core will be made of an electrically conductive material, such as aluminum. An electrical wire will be inserted into the tail of the core (through the center of the spring), and the tail is crushed around the electrical wire, forming a crimped connection. The core and spring are then inserted into the appropriate end cap, with the wire extending from the end cap. The two ends of the spring are fixed against (a) the bottom surface of the head and (b) a stop surface in the interior of the end cap.

Figure 12:
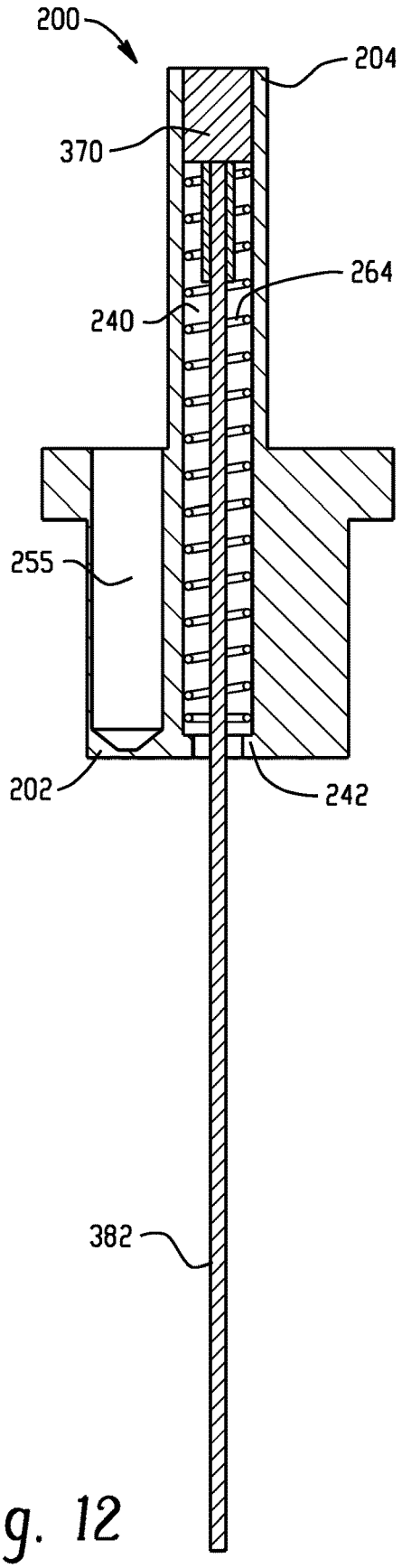
FIG. 12 is a cross-sectional view of a bottom end cap using the second version of the core.

FIG. 12 is a cross-sectional view illustrating the use of the second version of the core 370 of FIG. 14A in an end cap. The bottom end cap 200 has a first end 202 and a second end 204. A shaft 240 passes through the center of the end cap and extends entirely from the first end 202 to the second end 204 of the end cap. Second hole 255 is visible. The core 370, spring 364, and wire 382 are visible in the shaft 240. The two ends of the spring are fixed against the head 372 and shaft stop surface 242. The wire 382 travels through the center of the spring, or in other words the spring surrounds the wire.

It is contemplated that the length of the wire may range from about 1 foot to about 3 feet. For example, when used with the bottom end cap, it is contemplated that the wire is approximately one foot (1') long. When used with the top end cap, it is contemplated that the wire is about two feet (2') long to about three feet (3') long. This greater length is needed because, referring to FIG. 1A, this greater length is used to replace the through wire 140 that is wrapped around the exterior of the charge carrier. The wires of the two end caps are then wired to the addressable switch. Of course, the relative wire lengths can be reversed if desired.

Figure 13:
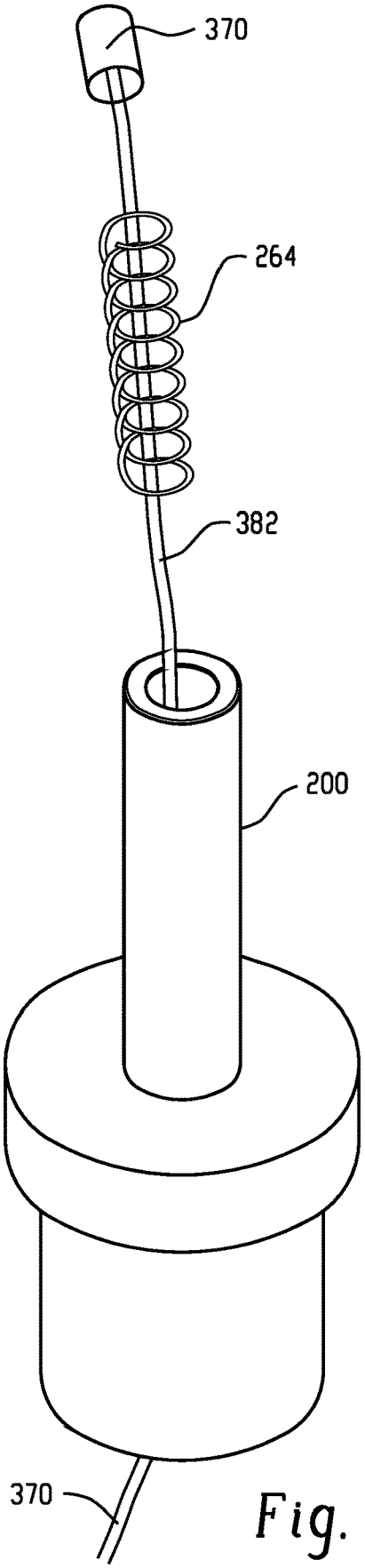
FIG. 13 is a picture showing the second version of the core crimped around a wire. The wire passes through the spring, and this assembly is placed within the bottom end cap in the picture.

FIG. 13 is a picture showing the second version of the core 370 crimped around a wire 382. Here, the wire 382 passes through the spring 264, and this assembly is then placed within a bottom end cap 200.

The bottom end caps and top end caps of the present disclosure can be made using known manufacturing techniques. For example, the main body, collar, and tube portions can be made from a non-conductive (or electrically insulating) material using reaction injection molding (RIM) or by 3-D printing. Various plastic/polymeric materials would be suitable for the main body, collar, and tube portions. The ground rings described in FIG. 4A are made from an electrically conductive material, for example metal or electrically conductive polymers.

The present disclosure has been described with reference to exemplary embodiments. Modifications and alterations will occur to others upon reading and understanding the preceding detailed description. It is intended that the present disclosure be construed as including all such modifications and alterations insofar as they come within the scope of the appended claims or the equivalents thereof.

The invention claimed is:

1. A bottom end cap for a perforating gun, comprising:
(A) a main body defining a first end of the end cap;
(B) a tube defining a second end of the end cap;
(C) a collar between the body and the tube, the collar forming a stop surface facing the second end of the end cap;
(D) a shaft passing through the tube and the collar;
(E) a first hole extending entirely through the collar and the main body; and
(F) a second hole adjacent the first hole, extending through the collar into the main body and including a stop surface.

2. The bottom end cap of claim 1, further comprising:
an addressable switch located within the main body;
an electrically conductive ground ring on an outer surface of the bottom end cap which is electrically connected to the addressable switch and acts as a ground; and
an electrically conductive core at the second end of the bottom end cap which is electrically connected to the addressable switch and acts as a bottom through-wire.

3. The bottom end cap of claim 2, further comprising a positive contact wire, a negative contact wire, and a top through-wire which are also electrically connected to the addressable switch.

4. The bottom end cap of claim 2, wherein the main body includes a first inner sidewall surrounding the first hole and the second hole, a second inner sidewall surrounding the shaft, and an outer sidewall around a perimeter of the main body.

5. The bottom end cap of claim 1, wherein the main body includes a sidewall surrounding the first hole and the second hole, and the main body is offset from the shaft.

6. The bottom end cap of claim 5, wherein the collar has at least one opening that is offset from the main body.

7. The bottom end cap of claim 1, wherein the main body includes a cutout beyond a radius of the shaft, and the collar has an opening that is aligned with the cutout of the main body.

8. The bottom end cap of claim 1, wherein the main body, the tube, and the collar are all cylindrical and are concentric about the shaft.

9. The bottom end cap of claim 8, wherein the shaft extends entirely from the first end to the second end of the end cap.

10. The bottom end cap of claim 1, wherein the tube has a diameter less than a diameter of the main body, and wherein the collar has a diameter greater than the diameter of the main body.

11. The bottom end cap of claim 1, wherein the shaft contains:

(i) a pin that extends outward from the first end of the bottom end cap, and (ii) an electrically conductive core at the second end of the bottom end cap that is electrically connected to the pin.

12. The bottom end cap of claim 11, wherein a spring traveling through the shaft electrically connects the core to the pin.

13. The bottom end cap of claim 1, wherein the shaft contains:

(i) an electrically conductive core at the second end of the bottom end cap which is connected to a wire, and (ii) a spring.

14. The bottom end cap of claim 13, wherein the core comprises a head and a tail, with the tail being crimped around the wire, and the wire travels through a center of the spring.

15. A bottom end cap for a perforating gun, comprising:

(A) a main body defining a first end of the end cap;

(B) a tube defining a second end of the end cap;

(C) a collar between the body and the tube, the collar forming a stop surface facing the second end of the end cap;

(D) a shaft passing through the tube and the collar, the shaft containing an electrically conductive core and a spring that biases the core towards the second end of the end cap;

(E) a first hole extending entirely through the collar and the main body; and (F) a second hole adjacent the first hole, extending through the collar into the main body and including a stop surface.

16. The bottom end cap of claim 15, further comprising an addressable switch located within the main body which is electrically connected to the core.

17. The bottom end cap of claim 16, further comprising an electrically conductive ground ring on an outer surface of the bottom end cap which is electrically connected to the addressable switch and acts as a ground.

18. A bottom end cap for a perforating gun, comprising:

(A) a main body defining a first end of the end cap;

(B) a tube defining a second end of the end cap, the tube having a diameter less than a diameter of the main body;

(C) a collar between the body and the tube, the collar forming a stop surface facing the second end of the end cap, the collar having a diameter greater than the diameter of the main body;

(D) a shaft passing through the tube and the collar;

(E) a first hole extending entirely through the collar and the main body; and (F) a second hole adjacent the first hole, extending through the collar into the main body and including a stop surface;

wherein the first hole and the second hole are radially offset from the shaft.

19. The bottom end cap of claim 18, further comprising an addressable switch located within the main body which is electrically connected to an electrically conductive core within the shaft.

20. The bottom end cap of claim 19, further comprising an electrically conductive ground ring on an outer surface of the bottom end cap which is electrically connected to the addressable switch and acts as a ground.

* * * * *